US005405143A

United States Patent [19]

Takemoto et al.

[11] Patent Number: 5,405,143

[45] Date of Patent: Apr. 11, 1995

[54] APPARATUS WITH FUNCTION OF DETECTING LOCATION OF METAL BODY

[75] Inventors: Takatoshi Takemoto; Kazunari Kawashima, both of Tokyo; Shigeru Handa, Hachioji, all of Japan

[73] Assignee: Kabushiki Kaisha Ace Denken, Tokyo, Japan

[21] Appl. No.: 855,628

[22] PCT Filed: Sep. 17, 1991

[86] PCT No.: PCT/JP91/01236

§ 371 Date: May 5, 1992

§ 102(e) Date: May 5, 1992

[87] PCT Pub. No.: WO92/04954

PCT Pub. Date: Apr. 2, 1992

[30] Foreign Application Priority Data

| | | | |
|---|---|---|---|
| Sep. 14, 1990 | [JP] | Japan | 2-244897 |
| Sep. 14, 1990 | [JP] | Japan | 2-244898 |
| Sep. 14, 1990 | [JP] | Japan | 2-244899 |
| Sep. 14, 1990 | [JP] | Japan | 2-244901 |
| Sep. 14, 1990 | [JP] | Japan | 2-244902 |

[51] Int. Cl.[6] ..... A63F 7/02

[52] U.S. Cl. ..... 273/121 B; 273/120 A

[58] Field of Search ..... 273/118 R, 118 A, 119 R, 273/112 A, 121 A, 121 B, 237, 238, 239

[56] References Cited

U.S. PATENT DOCUMENTS

| | | | |
|---|---|---|---|
| 3,760,404 | 9/1973 | Khlebutin | 273/238 |
| 4,492,581 | 1/1985 | Arai et al. | 273/238 |
| 4,927,145 | 5/1990 | Davis . | |
| 5,082,286 | 1/1992 | Ryan et al. | 273/238 |

FOREIGN PATENT DOCUMENTS

| | | | |
|---|---|---|---|
| 0248407 | 12/1987 | European Pat. Off. . | |
| 0507953A1 | 10/1992 | European Pat. Off. . | |
| 51-19379 | 6/1976 | Japan . | |
| 0133328 | 11/1978 | Japan | 273/238 |
| 60-114283 | 6/1985 | Japan . | |
| 61-181480 | 8/1986 | Japan . | |
| 63-282684 | 11/1988 | Japan . | |
| 64-3560 | 1/1989 | Japan . | |
| 2103943 | 3/1983 | United Kingdom | 273/238 |

*Primary Examiner*—Jessica J. Harrison

*Attorney, Agent, or Firm*—Lowe, Price, LeBlanc & Becker

[57] ABSTRACT

The present invention consists of an apparatus comprising a signal sending line which has a folded-back shape, and which serves to send a current for generating a magnetic field; and a signal receiving line which has a folded-back shape, which is arranged at a position permitting it to be electromagnetically coupled with the signal sending line, and which serves to detect a magnetic flux change caused by the approach of metal. The plurality of signal sending lines are arranged coplanarly, while the plurality of signal receiving lines are arranged coplanarly. The signal sending lines and the signal receiving lines are arranged with their planes held in parallel and in directions intersecting to each other, thereby constructing a sensing matrix. The sensing matrix is arranged in opposition to a panel along which a metal body to be detected moves, while holding therebetween a space which is, at least, large enough to pass the metal body. Signal sending means and signal receiving means are connected to the sensing matrix so as to detect the location the metal body.

25 Claims, 31 Drawing Sheets

APPARATUS WITH FUNCTION OF DETECTING LOCATION OF METAL BODY

TECHNICAL FIELD

The present invention relates to an apparatus with the function of detecting the location of a metal body. More particularly, it relates to an apparatus which has the function of detecting the location of a metal body within, for example, a space held between parallel planes.

BACKGROUND ART

Apparatuses which need to have the function of detecting the location of a metal body are, for example, metal detectors and game machines. By way of example, some of the game machines are such that a metal body, e.g., a metal ball is moved within a specified space which has been set in the game machine, and that whether or not a prize is won is determined in accordance with the movement of the ball. A typical example of such a game machine is, for example, a "pachinko" (Japanese upright pinball) game machine with which a game player causes a metal "pachinko" ball to move down within a space held between parallel planes and provided with a large number of obstacles.

The "pachinko" game machine has a panel which defines the space for moving the "pachinko" ball, a glass plate which covers the panel at a fixed interval therefrom, and a projectile mechanism which functions to project the "pachinko" ball to the upper part of the panel. The "pachinko" game machine is so installed that the panel extends substantially in the vertical direction. The panel is formed with a plurality of safe holes, each of which serves to make a hit when the "pachinko" ball has been led thereinto and driven out of the panel, and a single out hole into which the "pachinko" balls having failed to enter the safe holes are finally gathered to be driven out of the panel. Besides, a large number of pins (or nails) are planted on the panel substantially perpendicularly thereto in the stage in which they protrude from the panel to a distance corresponding to the diameter of each "pachinko" ball, in order that the "pachinko" ball falling along the panel may frequently collide against the pins to have its moving direction altered. The pins are arranged on the panel in a predetermined distribution in which, while altering the moving direction of the colliding "pachinko" ball, they lead this ball so as to proceed toward the safe hole in some cases and to miss the safe hole in other cases.

Owing to the construction as stated above, the "pachinko" game machines come to have individualities. A machine may have easy or difficult to register hits depending upon the slight differences of the respective machines in the arrangement and inclinations of the pins. Even identical machines have differences such that it has a high hit rate and a low hit rate for safe hole. Moreover, the differences are various among the machines.

In a game center or the like where the game machines of this type are installed in large numbers, knowing the individualities of the respective game machines is important for management in relation to the profit administration and customer administration of the game center. By way of example, when many of the machines register hits excessively, the game center side suffers a loss, whereas when all the machines are difficult to register hits on, customers become disinterested, which is unfavorable to business. Accordingly, countermeasures need to be taken by knowing the individualities of the respective game machines which are installed in the center.

For such a purpose, it is practiced to detect the moving courses of the "pachinko" balls in the "pachinko" game machine. In the official gazette of Japanese Patent Application Publication No. 3560/1989, for example, there is disclosed an apparatus equipped with an upper sheet and a lower sheet which have a pair of contacts. This technique senses the existence of the "pachinko" ball in such a way that the "pachinko" ball gets on the upper sheet and depresses it, whereby the pair of contacts come into touch.

With the prior-art apparatus, however, since the sheets have the pairs of contacts, they are restricted in arrangement, and they can be arranged only along the passages of the "pachinko" balls. It is therefore impossible to detect the motions of the balls from the point of view at which the whole panel is seen. This results in a difficult problem of detecting, for example, how the balls enter the safe holes and the out hole.

In addition, since the detection is based on the physical touch of the pair of contacts, it can take place in some moving states of the ball that the depression of the sheet becomes too weak to bring the pair of contacts into touch, so the motion of the ball is not detected. Besides, inferior touches can occur due to the wear, corrosion etc. of the pair of contacts. Further, the erroneous touch of the pair of contacts can be incurred by a vibration or the like or by chattering. For these reasons, the apparatus lacks reliability.

Another problem is that, since a pressure applied by the ball is utilized, the motion of the ball is delicately affected.

Such problems can be encountered, not only in the "pachinko" game machine, but also in different machines. It is accordingly desired to overcome these problems.

DISCLOSURE OF THE INVENTION

An object of the present invention is to provide an apparatus with the function of detecting the location of a metal body, according to which any location of the metal body within a specified space can be detected out of touch with the metal body and without employing contacts attended with a physical touch, whereby a detected result of high reliability is obtained.

In order to accomplish the object, according to one aspect of the present invention, there is provided an apparatus with a function of detecting a metal body, characterized by comprising a sensor including a signal sending line which has a folded-back shape, and which serves to send a current for generating a magnetic field; and a signal receiving line which has a folded-back shape, which is arranged at a position permitting it to be electromagnetically coupled with the signal sending line, and which serves to detect a magnetic flux change caused by the approach of a metal object; wherein the signal sending line and the signal receiving line are arranged with their planes held in parallel.

The sensor can be constructed as a sensing matrix in which the plurality of signal sending lines are arranged coplanarly, the plurality of signal receiving lines are arranged coplanarly, and the signal sending lines and the signal receiving lines are arranged with their planes held in parallel and in directions intersecting each other.

The sensing matrix can be constructed by arranging the plurality of signal sending lines and plurality of signal receiving lines so as to intersect orthogonally.

The sensing matrix can be constructed by leading the plurality of signal sending lines and the plurality of signal receiving lines unidirectionally, and curvedly extending them in directions intersecting to each other, so as to arrange them in the intersecting directions.

The sensing matrix can be constructed by including a base plate, and by arranging the plurality of signal sending lines on one surface of the base plate and arranging the plurality of signal receiving lines on the other surface of the base plate in the direction intersecting with the direction of the signal sending lines.

In addition, according to the present invention, there is provided an apparatus with a function of detecting a metal body, further comprising signal sending means for successively sending signals of predetermined frequency to the respective signal sending lines, and signal receiving means for successively receiving the signals at respective signal receiving circuit channels in synchronism with the signal sending circuit.

It is possible to further comprise noise detection means for detecting noise of the signal received by the signal receiving means, to deliver a noise detection signal as an output, and sending interrupt means for stopping the signal sending operation of the signal sending means in accordance with the noise signal from the noise detection means.

Besides, it is possible to further comprise noise level measurement means for measuring a level of the detected noise at each frequency, and frequency switching means for changing over the frequency of the sent signal of the signal sending means to a frequency not affected by the detected noise, on the basis of a measured result of the noise level detection means.

In addition, according to the present invention, there is provided an apparatus further comprising a panel along which the metal body which is to be detected moves, wherein the sensing matrix is arranged in opposition to the panel while holding therebetween a space which is, at least, large enough to pass the metal body, and wherein the signal sending means and the signal receiving means are connected to the sensing matrix, making it possible to detect the location of the metal body.

The panel is formed with a plurality of safe holes each of which serves to make a hit when the metal body has entered the hole and is so driven out of the panel, and a single out hole into which the metal bodies having failed to enter any safe holes are finally gathered and driven out of the panel. Also, a plurality of pins are planted on the panel substantially perpendicularly thereto in a state in which they protrude from the panel to a distance corresponding to a diameter of the metal body, in order that the metal body falling along the panel may frequently collide against the pins to have its moving direction altered. Further, the apparatus can further comprise a projectile mechanism for projecting the metal body to an upper part of the panel.

The pins have their distribution determined and are arranged on the panel so that, while altering the moving direction of the colliding metal body, they may lead the metal body so as to proceed toward safe holes in some cases and so as to miss safe holes in other cases.

A metal ball is employed as the metal body, whereby the apparatus can be used as a game machine.

When the magnetic field is generated by causing the current to flow through the signal sending line in the folded-back shape, an induced current is produced by the electromagnetic induction in the signal receiving line near the signal sending line. On this occasion, when the metal body approaches the signal sending line and the signal receiving line, an eddy current is produced in the surface of the metal body in the direction of canceling the magnetic flux based on the signal sending line. Therefore, the magnitude of the induced current produced in the signal receiving line changes under the influence of the eddy current. The approach of the metal body can be sensed by detecting the change.

In the case where the plurality of signal sending lines and signal receiving lines are comprised and are arranged in the intersecting directions so as to construct the sensing matrix, the signal sending line and the signal receiving line whose electromagnetic characteristics have changed with the approach of the metal body are detected, and the position of the metal body in the sensing matrix can be grasped as coordinates from the intersecting position of the detected signal sending and receiving lines. These signal sending and receiving lines can be specified by sensing the signal sending line which is driven by scanning, and the signal receiving line whose signal reception is selected by scanning.

BEST MODES FOR CARRYING OUT THE INVENTION

Now, various embodiments of the present invention will be described with reference to the drawings.

FIGS. 1~8 show the first embodiment of the present invention. The first embodiment illustrates a case where a metal detection apparatus is constructed using a metal sensor and where it is applied to a game machine 10.

Figure 2:
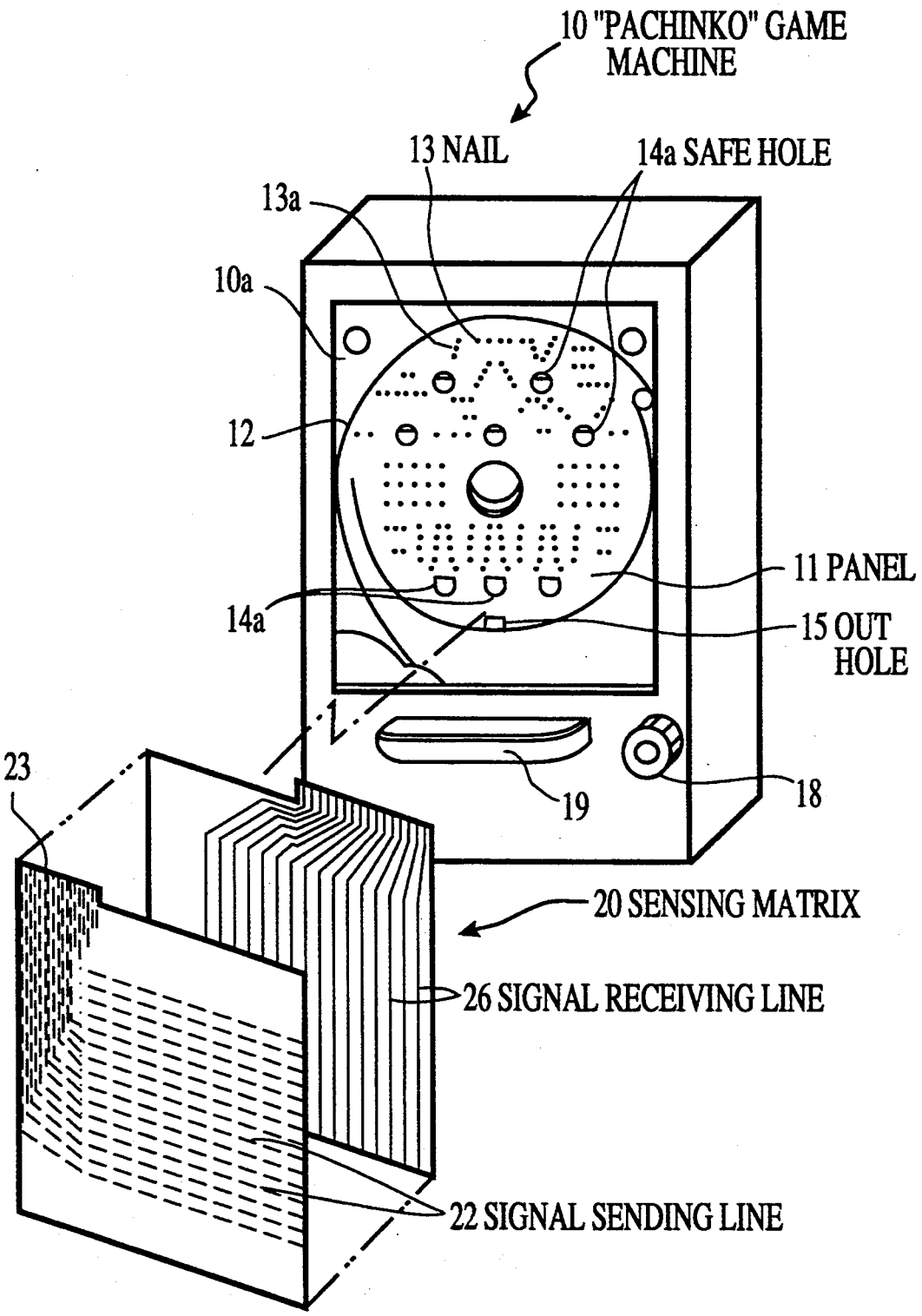
FIG. 2 is a perspective view showing a game machine and the sensing matrix which are conceptually disintegrated.
Figure 3:
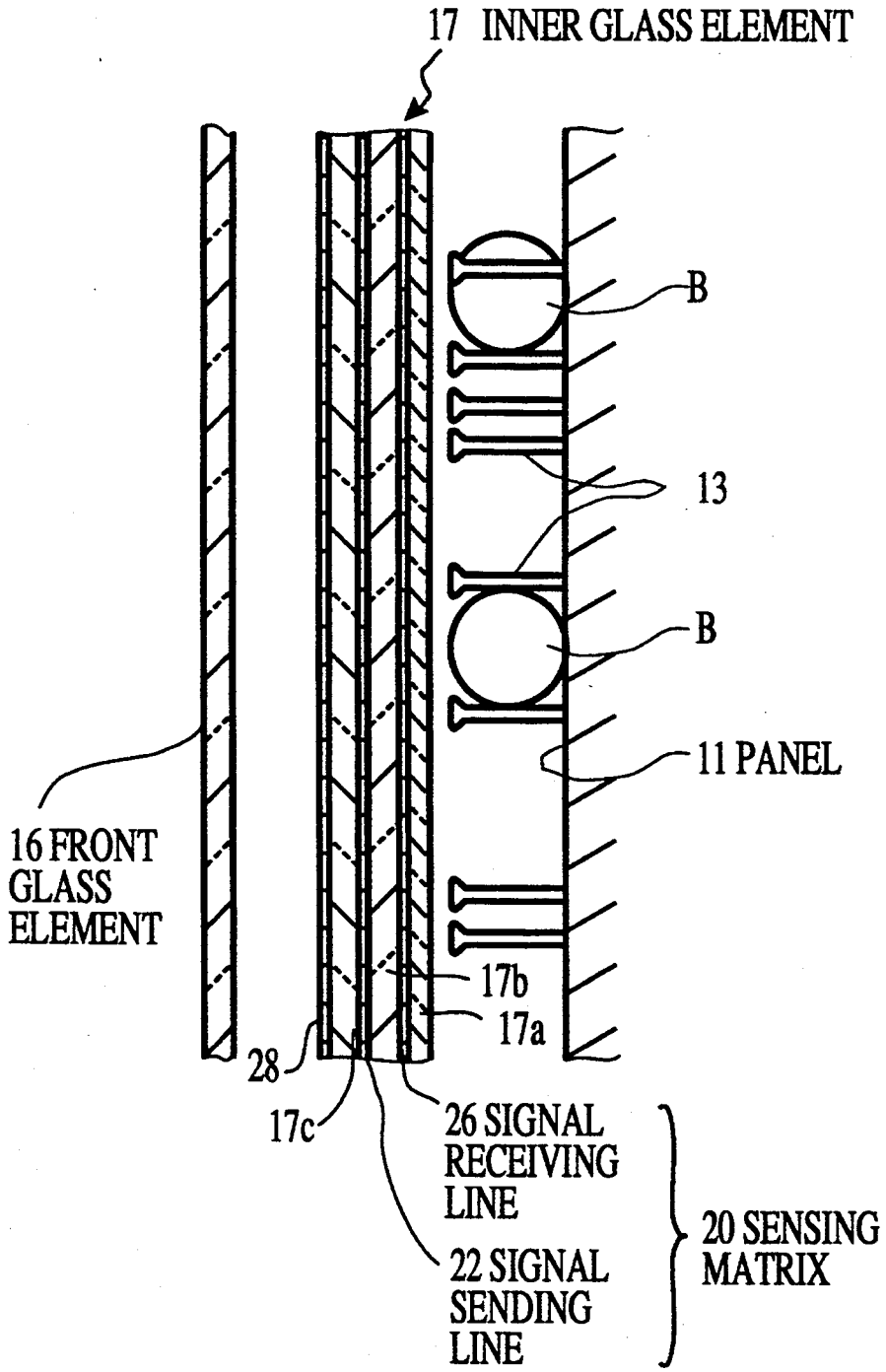
FIG. 3 is a vertical sectional view of a part of the game machine.

As shown in FIGS. 2 and 3, the game machine 10 includes a panel 11 which defines a space for moving a metal ball B, a glass cover 10*a* which covers the panel 11 with a fixed interval held therebetween, and a projectile mechanism which serves to project the metal ball B toward the upper part of the panel 11. This game machine 10 is so installed that the panel 11 extends substantially in the vertical direction.

A guide rail 12 for defining a game region is mounted on the panel 11 of the game machine 10. A domain inside the guide rail 12 is the game region. A large number of pins (or nails) 13, 13, . . . for repelling the metal ball B are planted and erected on the part of the panel 11 within the game region. In addition, a plurality of 'safe' holes 14*a*, 14*a*, . . . are provided in various places, and a single 'out' hole 15 is provided at the lower end of the game region.

As depicted in FIG. 3, the pins 13 are erected to be substantially perpendicular in the state in which each pin protrudes from the panel 11 by a length corresponding to the diameter of the metal ball B. Besides, the pins 13 are arranged so that the metal ball which falls along the panel 11 while passing between the pins 13, 13 may frequently collide against the large number of pins 13 existent in its traveling course, thereby having its direction of movement changed. More specifically, as depicted in FIG. 2, at least two of the pins 13 gather to form a pin line or pin group 13*a*. Such pin lines or pin groups 13*a* have their distribution determined in such a manner that, while having its direction of movement altered, the colliding metal body may be led so as to proceed toward the safe hole 14*a* in some cases or to miss the safe hole 14*a* in other cases, depending upon the projected position of the metal body, namely, the fall starting point thereof, the moving direction and speed thereof on that occasion, and so on.

The safe hole 14*a* is a hole which serves to make a hit when the metal body enters it and is driven out of the panel 11. On the other hand, the out hole 15*a* is a hole into which the metal bodies having failed to enter any of the safe holes 14*a* are finally collected to be driven out of the panel 11.

The front glass cover 10*a* covering the panel 11 has a double structure composed of a front glass element 16 and an inner glass element 17.

The projectile mechanism includes a striking handle 18, and a drive mechanism not shown. The handle 18 is mounted at the front of the game machine 10, and is used for the operation of striking or knocking the metal body. The striking operation is effected by rotating the handle 18 a desired angle.

Also, a ball dish 19 for receiving the metal bodies delivered by the game machine 10 is mounted at the front of this game machine. A predetermined number of metal bodies are awarded as a prize when the metal body projected to the panel 11 has entered any of the safe holes 14*a*.

As shown in FIGS. 2 and 3, a sensing matrix 20 constituting the metal sensor is arranged extending along the panel 11 of the game machine 10. Of the front glass element 16 and the inner glass element 17 constituting the front glass cover 10*a* for covering the panel 11, the latter 17 which lies inwards as viewed from the game machine 10, namely, nearer the panel 11 is provided with the sensing matrix 20.

The inner glass element 17 is constructed by stacking three layers; an inner protective glass plate 17*a* which is a protective sheet for signal receiving lines 26, a glass base plate 17*b*, and an outer glass plate 17*c* which is a protective sheet for signal sending lines 22. The signal receiving lines 26 to be described later are laid in such a manner as to be sandwiched in between the inner protective glass plate 17*a* and the glass base plate 17*b*. The signal sending lines 22 to be described later are laid in such a manner as to be sandwiched in between the glass base plate 17*b* and the outer glass plate 17*c*.

The whole front surface of the outer glass plate 17*c* lying in front of the plurality of signal sending lines 22 is formed with a transparent conductive film 28. The transparent conductor film 28 is made of, for example, an indium-tin oxide (I. T. O.) film or a tin oxide film.

Figure 1:
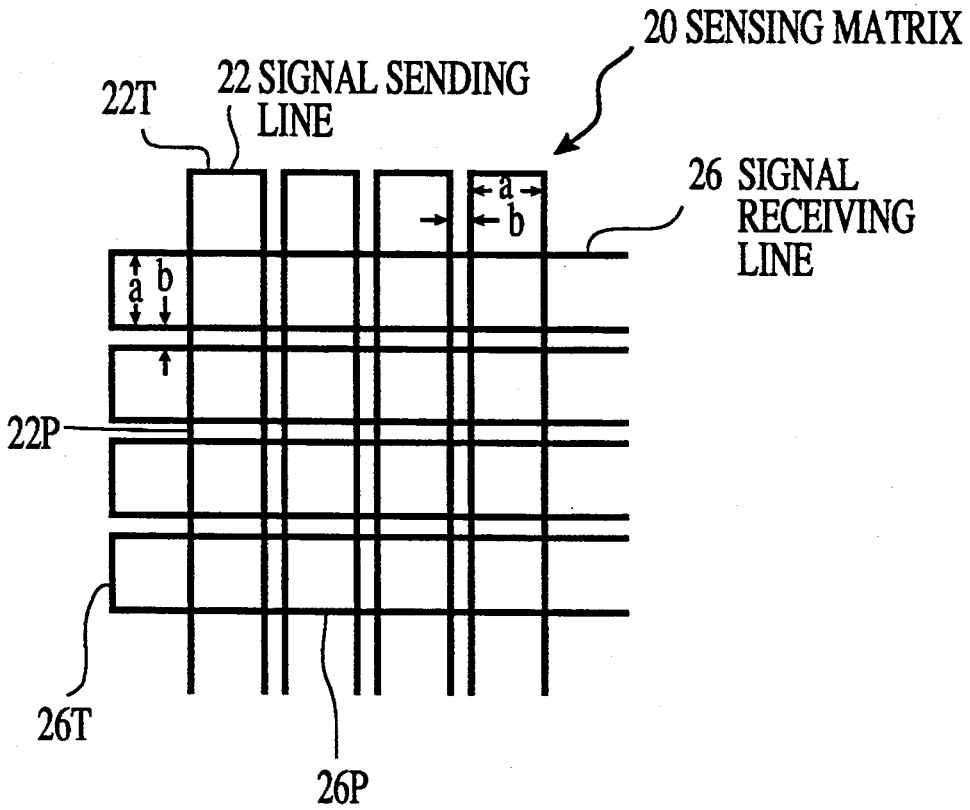
FIG. 1 is a schematic front view showing the configuration of a sensing matrix for use in the first embodiment of the present invention.

As illustrated in FIG. 1, each of the signal sending lines 22 is laid in a folded-back shape (or a loop shape) having a paralleled portion 22P in which an outward path and a return path run in parallel, and a turning portion 22T in which the outward path is turned back to the return path. Also, each of the signal receiving lines 26 is laid in a folded-back shape (or a loop shape) having a paralleled portion 26P in which an outward path and a return path run in parallel, and a turning portion 26T in which the outward path is turned back to the return path. The plurality of signal sending lines 22 are arranged on the glass base plate 17*b* so that their paralleled portions 22P may be arrayed within an identical plane and may extend in parallel to one another. Likewise, the plurality signal receiving lines 26 are arranged on the glass base plate 17*b* so that their paralleled portions 26P may be arrayed within an identical plane and may extend in parallel to one another. Besides, the signal sending lines 22 and the signal receiving lines 26 are laid out so as to intersect to each other with, for example, the former lines 22 juxtaposed in a column direction and the latter lines 26 juxtaposed in a row direction, thereby constructing the sensing matrix.

Figure 5:
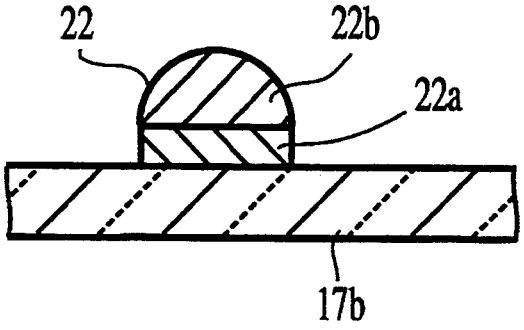
FIG. 5 is an enlarged sectional view of an example of a signal sending line or a signal receiving line for use in the present invention.

As shown in FIG. 5, the signal sending line 22 is manufactured in such a way that a metal such as aluminum 22*a* is evaporated onto one surface of the glass base plate 17*b*, thereby forming the folded-back pattern of this signal sending line, and that the evaporated part is plated with a metal such as copper 22*b* along the pattern, thereby forming a metal plating pattern. The signal receiving line 26 is similarly manufactured in such a way that aluminum is evaporated onto the other surface of the glass base plate 17*b*, thereby forming the folded-back pattern of this signal receiving line, and that the evaporated part is plated with copper.

The reaction sensitivity of at least either of the signal sending line 22 and the signal receiving line 26 can be controlled by changing the thickness of the copper plating film. By way of example, when the copper plating is thickened, the D.C. resistance of the signal sending line 22 or the signal receiving line 26 decreases to heighten the reaction sensitivity thereof to the metal body.

The inner glass element 17 is so fabricated that the inner protective glass plate 17*a* and the outer glass plate 17*c* are respectively joined on the surface of the glass base plate 17*b* bearing the signal receiving lines 26 and on the surface thereof bearing the signal sending lines 22, with layers of a transparent adhesive.

As illustrated in FIG. 1, each of the signal sending lines 22 is U-turned into the folded-back shape of the parallel paths, and the plurality of signal sending lines 22 are arranged on the identical plane while extending in parallel unidirectionally. Likewise, each of the signal receiving lines 26 is U-turned into the folded-back shape of the parallel paths, and the plurality of signal receiving lines 26 are arranged on the identical plane while extending in parallel unidirectionally.

Each of the signal receiving lines 26 is arranged near the signal sending lines 22 so as to be electromagnetically coupled with these lines 22. More specifically, the signal receiving lines 26 are laid in the direction of intersecting orthogonally to the signal sending lines 22 at a position where their plane is parallel to the plane of the signal sending lines 22 (that is, where the plane containing the signal sending lines 22 in the folded-back shape and the plane containing the signal receiving lines 26 in the folded-back shape are held parallel), in order that the electromagnetic characteristics of the lines 22 and 26 may be changed by the approach of metal such as the metal body B.

In the front view of FIG. 1, individual square parts enclosed with the intersecting signal sending lines 22 and signal receiving lines 26 form sensing units 20*a*, 20*a*, . . . each of which senses the metal body on the basis of the change of an impedance being an electromagnetic characteristic value.

Figure 4:
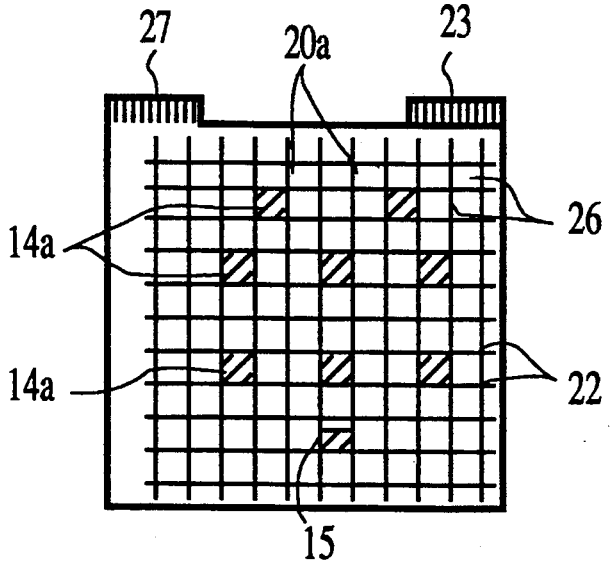
FIG. 4 is a front view of the sensing matrix.

Terminals 23 and 27 for external connections are respectively provided at the end parts of the plurality of signal sending lines 22 and the plurality of signal receiving lines 26. Besides, as shown in FIG. 4, some of the sensing units 20*a*, 20*a*, . . . correspond to the positions of existence of the safe holes 14*a*, 14*a*, . . .

Incidentally, the pattern shapes of the signal sending line 22 and signal receiving line 26 are delicate in relation to the size of the metal body B. When the sensing units 20*a*, 20*a*, . . . are too large, the resolving power of the metal sensor is inferior. When they are too small, the scanning rate of the metal sensor needs to be raised instead of an enhanced resolving power which permits an accurate pattern recognition.

Therefore, the D.C. resistances of the signal sending line 22 and signal receiving line 26 are set preferably at 10 Ω to 200 Ω inclusive and most preferably at about 25 Ω, as the best value of the reaction sensitivity to the metal body B.

In addition, as indicated in FIG. 1, the turning-back width a of both the signal sending lines 22 and signal receiving lines 26 is set preferably between 4 mm and 16 mm inclusive and most preferably at 8 mm, as a value affording a good reaction sensitivity for sensing the metal body B. Besides, regarding the spacing b between the adjacent signal sending lines 22 or signal receiving lines 26, a value in the order of 0.5~2 mm exhibits a favorable result.

The pattern of the sensing matrix 20 suitable for the ordinary game machine 10 is one in which the signal sending lines 22 are in 32 rows, while the signal receiving lines 26 are in 32 columns, so that there are a total number of 1024 sensing units 20*a*.

Moreover, the diameter of the conductor of which each of the signal sending lines 22 and signal receiving lines 26 is made affects the sensitivity greatly. More specifically, when the diameter of the conductor is small, the impedance thereof becomes too high. When the diameter is large, the sensitivity worsens because the inside diameter of the pattern becomes small.

Further, since the sensing matrix 20 is disposed within the inner glass element 17 covering the panel 11, the diameter of the conductor needs to be very thin so as to prevent this sensing matrix from offending the eye when playing the game. Therefore, the diameter of the conductor to form each of the signal sending lines 22 and signal receiving lines 26 is preferably set at a value of 20 μm to 50 μm inclusive.

Figure 6:
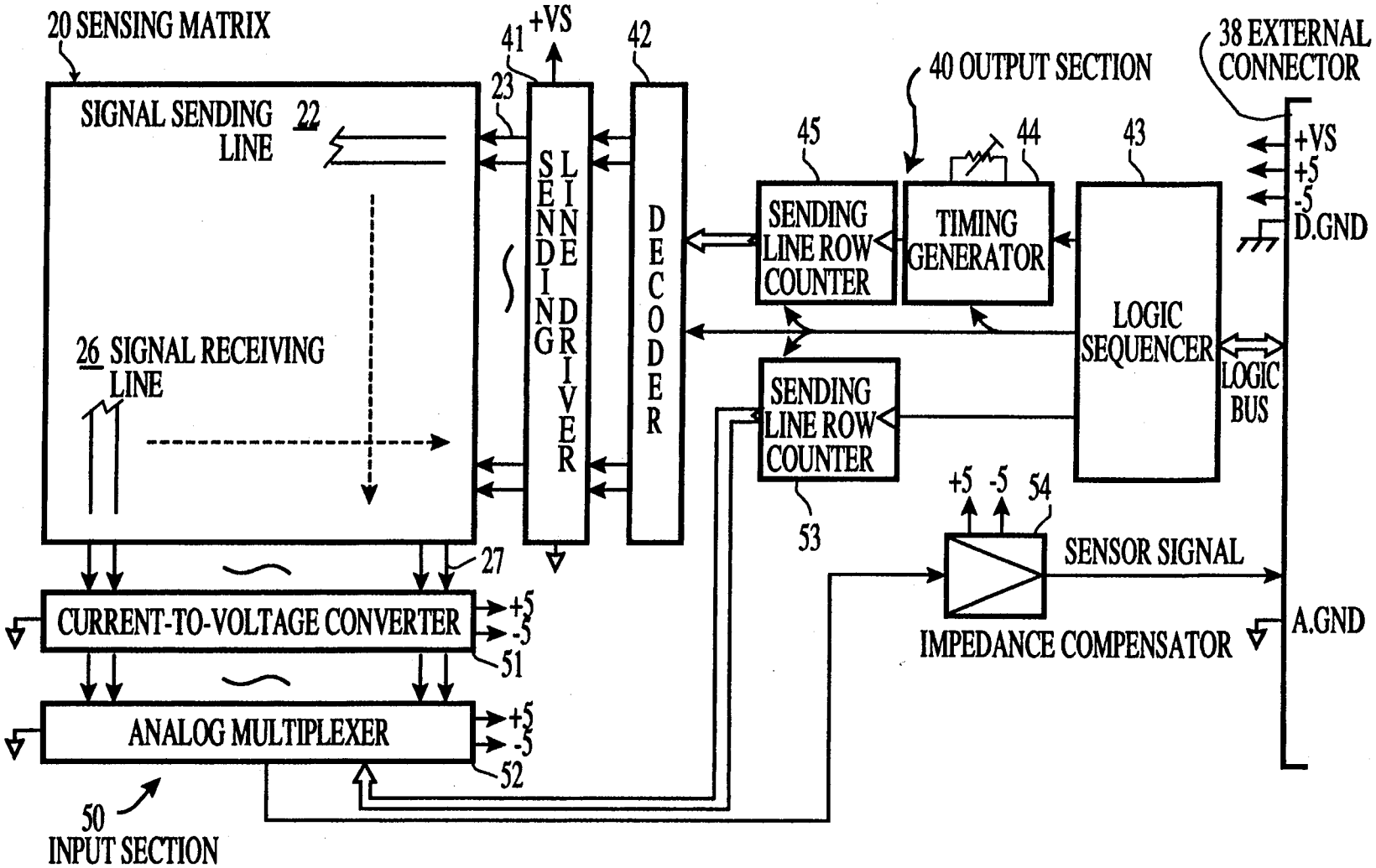
FIG. 6 is a block diagram showing the game machine side part of an example of a signal processing system for use in the present invention.
Figure 7:
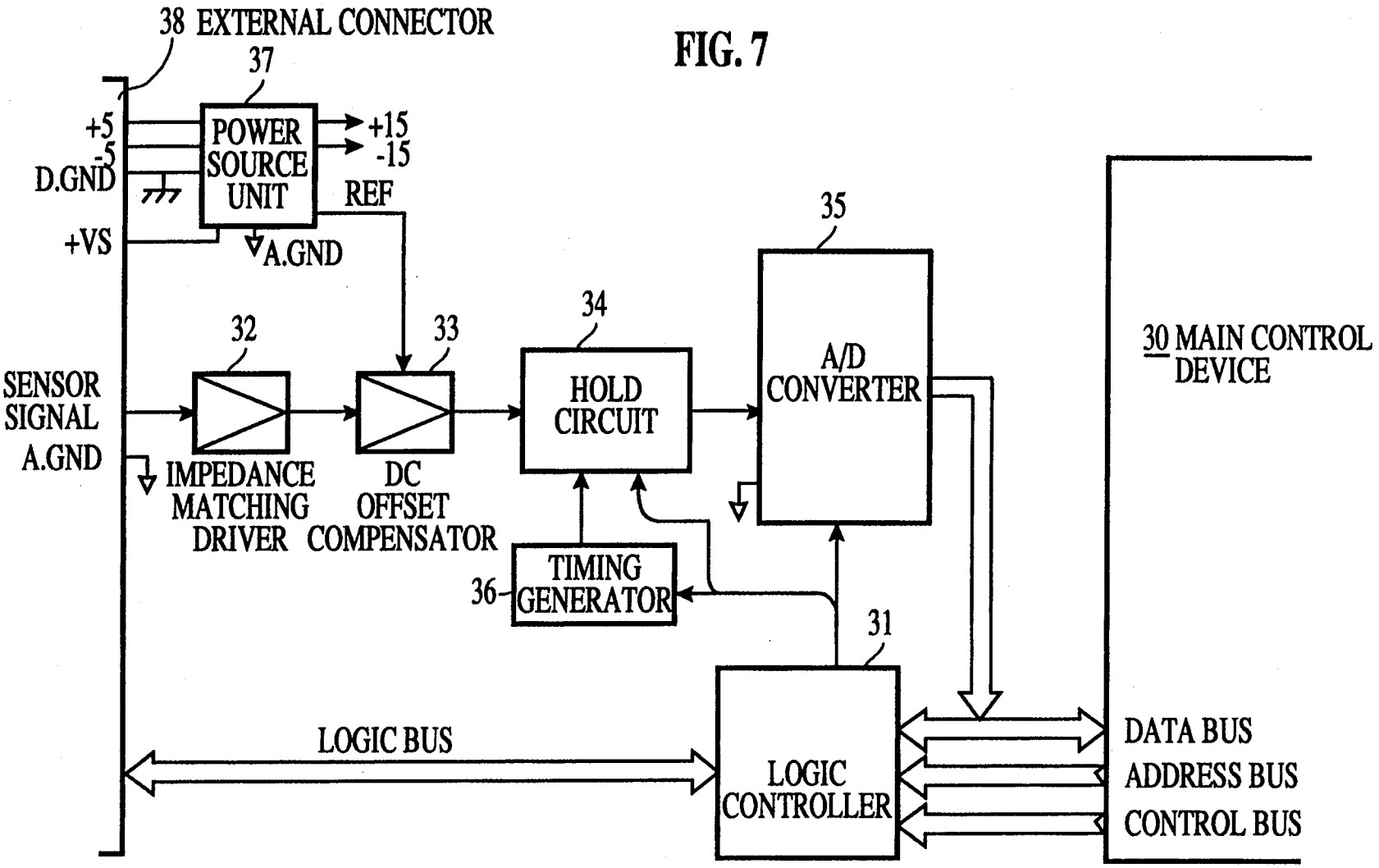
FIG. 7 is a block diagram showing the main control device side of the example of the signal processing system for use in the present invention.

A signal processing system which constitutes the metal detection apparatus for sensing the metal body, is as shown in FIGS. 6 and 7.

The system is operated under the control of a main control device 30. As illustrated in FIG. 7, it includes the main control device 30; a logic controller 31 by which control signals from the main control device 30 are relayed; an impedance matching driver 32, a D.C. offset compensator 33, a hold circuit 34 and an A/D converter 35 which constitute an output loop from the sensing matrix 20 to the main control device 30; a timing generator 36; a power source unit 37; and an external connector 38. The logic controller 31 and the output loop are connected to the external connector 38. The main control device 30 is constructed of a computer including a central processing unit and a main memory though these are not shown.

Figure 8:
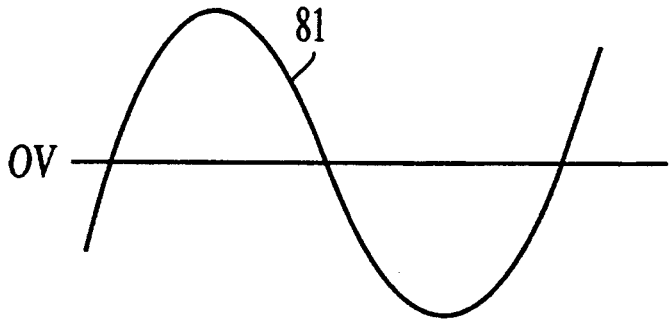
FIG. 8 is a schematic waveform diagram showing the waveform of a voltage which is applied to the signal sending line.

On the side of the game machine 10, there are provided an output section 40 which feeds power to the plurality of signal sending lines 22 of the sensing matrix 20, and an input section 50 which receives signals from the plurality of signal receiving lines 26. The output section 40 is disposed to the side of the plurality of signal sending lines 22. As shown in FIG. 6, the output section 40 includes a signal sending driver 41 which applies signals to the signal sending lines 22, sequentially at predetermined cycles, and a decoder 42 which is connected to the signal sending driver 41 and which controls the signal sending driver 41 so as to operate sequentially in accordance with the control signals generated by the main control device 30. As shown in FIG. 8 by way of example, a continuous sinusoidal wave having a frequency of 1 MHz and centering at 0 V is suitable as a voltage waveform 81 which is applied to the signal sending lines 22.

Further, a logic sequencer 43, a timing generator 44 and a signal-sending-line row counter 45 are included in the output section 40.

The logic sequencer 43 operates in accordance with the control signals from the main control device 30, and synchronizes the decoder 42 of the signal sending side with a multiplexer 52 of the signal receiving side to be described below. Simultaneously, it controls the timings of the starts and ends of the cycles of the scanning of the sequential signals of the decoder 42.

The timing generator 44 determines the cycles of the scanning. Herein, the frequency of the scanning needs to be at least 10 kHz for the purpose of coping with the motions of the metal body on the panel 11 of the game machine 10, and it is set at 100 kHz in the embodiment. The signal-sending-line row counter 45 counts the scanning cycles, and determines the signal sending line 22 to be scanned.

The input section 50 is disposed to the side of the plurality of signal receiving lines 26. It includes a converter 51 which is connected to the plurality of signal receiving lines 26 and which receives currents expressive of the electromagnetic characteristic values of the individual signal receiving lines 26, 26 . . . and converts them into voltage signals which are compatible with digital equipment at succeeding stages; and the multiplexer 52 which is connected to the converter 51 and which receives and delivers the signals from the individual signal receiving lines 26 in sequence.

Connected to the multiplexer 52 is a signal-receiving-line column counter 53 which is disposed at a stage succeeding the logic sequencer 43 of the output section 40. The output section 40 and the input section 50 are synchronized by the signal-sending-line row counter 45 and the signal-receiving-line column counter 53 which are connected to the logic sequencer 43. As the aspect of the synchronization, by way of example, one of the plurality of signal receiving lines 26 is subjected to the signal detection every scanning operation of the plurality of signal sending lines 22.

Alternatively, contrary to the above aspect of the synchronization, the signal receiving lines 26 may be scanned once for the detection every signal sending operation of one of the plurality of signal sending lines 22.

The output of the multiplexer 52 of the input section 50 is connected to the external connector 38 via an impedance compensator 54.

Next, the operation of this embodiment will be described.

Referring to FIG. 7, when the address signals and the control signals are respectively output from the main control device 30 to the logic controller 31 through an address bus and a control bus, they are transmitted to the game machine 10 via the external connector 38.

Referring to FIG. 6, in the game machine 10, the logic sequencer 43 of the output section 40 produces a sequence signal on the basis of the entered signals. The sequence signal is delivered to the decoder 42, the timing generator 44, and the signal-sending-line row counter 45 as well as the signal-receiving-line column counter 53.

The timing generator 44 determines the cycles at which each signal sending line 22 of the sensing matrix 20 is scanned. The signal-sending-line row counter 45 counts scanning cycle signals, and determines the signal sending line 22 to be driven. This counter 45 is operated in synchronism with the sequence signal from the logic sequencer 43.

The decoder 42 controls the signal sending driver 41 so as to operate in sequence. Thus, the signal sending driver 41 delivers signals to the signal sending lines 22 sequentially at the predetermined cycles.

On the side of the plurality of signal receiving lines 26, the converter 51 which has received the current signals expressive of the electromagnetic characteristic values appearing at the plurality of signal receiving lines 26 converts these current signals into the voltage signals which the digital circuits at the succeeding stages can handle.

The multiplexer 52 which has received the converted signals afforded from the individual signal receiving lines 26 delivers them sequentially at predetermined cycles. The decoder 42 on the signal sending side and the multiplexer 52 on the signal receiving side are synchronously operated by the count operations of the signal-sending-line row counter 45 and the signal-receiving-line column counter 53 which are in turn operated by the control signals of the logic sequencer 43 having its operation based on the control signals.

The logic sequencer 43 causes the converter 51 and multiplexer 52 on the signal receiving side to detect the information of one of the plurality of signal receiving lines 26 every scanning operation of the plurality of signal sending lines 22, or conversely to detect information items produced by scanning the plurality of signal receiving lines 26 once every signal sending operation of one of the plurality of signal sending lines 22.

When the voltage signal in the waveform as shown in FIG. 8 is applied to a certain one of the signal sending lines 22, an alternating magnetic field is generated in the paralleled portion 22P of the signal sending line. Thus, the signal receiving lines 26 intersecting with this signal sending line 22 fall into the states in which alternating voltages are induced by the electromagnetic induction, respectively. On this occasion, when the metal body has entered a space which any of the sensing units 20*a* belonging to the signal sending line 22 views, an eddy current is induced in the metal body. The eddy current generates a magnetic field in the sense of canceling a magnetic flux produced from the paralleled portion 22P. Consequently, the magnitude of the magnetic induction in the intersecting signal receiving line 26 changes in the sensing unit 20*a*, and the current induced in the signal receiving line 26 diminishes. In contrast, regarding the other signal receiving lines 26 which intersect with the identical signal sending line 22, such a change does not take place, and hence, the induced currents do not change. The particular signal receiving line 26 having its paralleled portion 26P at the position where the metal body exists, can be found by scanning the signal receiving lines 26 by the analog multiplexer 52 to measure or compare the output values thereof, and the column of the signal receiving line 26 whose output differs from the others is checked for. Also, the particular signal sending line 22 driven at that time can be found by checking the row thereof by way of example. Accordingly, the sensing unit 20*a* where the metal body exists can be known from the information items of both the lines.

Incidentally, by way of example, the signal sending line 22 which is driven and the signal receiving line 26 which is selected by the analog multiplexer 52 can be respectively known by obtaining the count value of the signal-sending-line row counter 45 and by obtaining the count value of the signal-receiving-line column counter 53. The position of the metal body can be grasped from the row of the signal sending line and the column of the signal receiving line, as the coordinates of the position where these lines intersect.

There are a total number of 1024 sensing units 20*a* which are in correspondence with the 32 rows of the signal sending lines 22 and the 32 columns of the signal receiving lines 26. Therefore, no matter which of the safe holes 14*a* and the out hole 15 in the panel 11 the metal body may pass through, it can be detected.

Incidentally, since the voltage waveform 81 for the signal sending lines 22 is the continuous sinusoidal wave centering at 0 V, noise as in the case of a square wave does not develop, and detrimental effects on the other devices such as the main control device 30 can be prevented.

Each of the sensor signals delivered from the multiplexer 52 is subjected to impedance compensation by the impedance compensator 54. Subsequently, the sensor signal delivered from the impedance compensator 54 enters the impedance matching driver 32 on the side of the main control device 30 via the external connector 38 and is subjected to impedance matching therein. The D.C. offset compensator 33 succeeding the impedance matching driver 32 receives only the reaction wave of the output from the sensing matrix 20 and delivers it to the hold circuit 34.

In the hold circuit 34, the data transmitted at high speed is temporarily held and stored until the end of the A/D conversion operation being carried out in the succeeding A/D converter 35. In the A/D converter 35, the analog signal from the sensing matrix 20 is converted into a digital signal containing a predetermined number of bits, for example, a 12-bit unit, so as to transmit the digital data to the main control device 30 via a data bus. The operations of the hold circuit 34 and A/D converter 35 are synchronized by the signal of the logic controller 31 or timing generator 36.

The motions of all the metal bodies on the sensing matrix 20 may well be stored for a long time in such a way that an output terminal is separately prepared for the A/D converter 35 and is connected to an unshown memory device.

Incidentally, since the signal sending lines 22 and the signal receiving lines 26 are folded back in the U-turns into the paralleled portions and are intersected orthogonally to each other, the sensing matrix 20 has a simple pattern which is inoffensive to the eye and can be readily fabricated of a wire material such as copper wire. Moreover, since the signal sending lines 22 and the signal receiving lines 26 of the sensing matrix 20 have smaller lengths and lower D.C. resistances than if they had bent portions, a good reaction sensitivity is attained.

In addition, the transparent conductor film 28 on the front surface of the outer glass plate 17*c* functions to shield the sensing matrix from the disturbing electrical influences of metals and dielectrics and also to raise the reaction sensitivity to the metal body.

The positions of the sensing units 20*a* corresponding to the safe holes 14*a* are stored, together with the position of the out hole 15 (the number of "hit" balls can be known when the number of the metal bodies projected and struck onto the panel 11 is counted without detecting the metal bodies in the out hole 15), whereupon the situation in which the metal bodies enter the individual holes is monitored with the progress of the game. Depending upon circumstances, the last strike (the end of the game) is managed, and any abnormality ascribable to an unfair practice is checked. Besides, data to be utilized for, e.g., adjusting the amount of direction change exerted on the metal bodies by the pins can be collected by finding the machine in which the metal bodies find it extraordinarily easy to enter only a specified one of the safe holes, the machine in which the metal bodies find it extraordinarily difficult to enter the safe holes, and so forth.

Now, the second embodiment of the present invention will be described.

Figure 9:
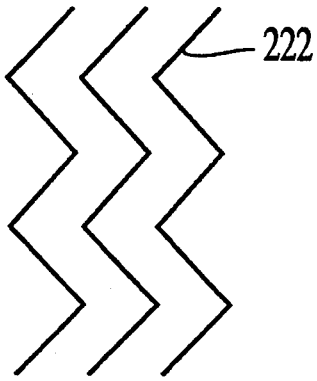
FIG. 9 is a schematic front view showing the shape of a signal sending line or a signal receiving line in the second embodiment.

FIG. 9 shows the shape of a signal sending line or a signal receiving line in the second embodiment. The signal sending line (or signal receiving line) 222 is bent in a zigzag fashion. Except for the different shape, this embodiment is the same as the first embodiment.

Now, the third embodiment of the present invention will be described.

Figure 10:
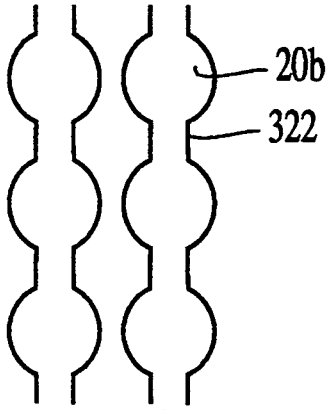
FIG. 10 is a schematic front view showing the shape of a signal sending line or a signal receiving line in the third embodiment.

FIG. 10 shows the shape of a signal sending line or a signal receiving line in the third embodiment. The signal sending line (or signal receiving line) 322 has the shape in which the portion of a sensing unit 20*b* is expanded to be circular. Also this embodiment is the same as the first embodiment except for the different shape.

Now, the fourth embodiment of the present invention will be described.

Figure 11:
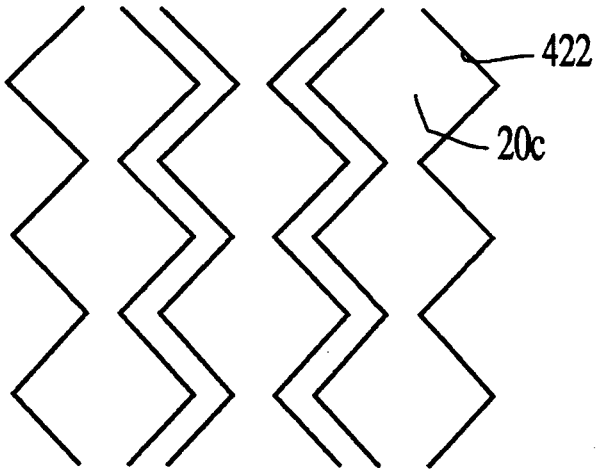
FIG. 11 is a schematic front view showing the shape of a signal sending line or a signal receiving line in the fourth embodiment.

FIG. 11 shows the shape of a signal sending line or a signal receiving line in the fourth embodiment. The signal sending line (or signal receiving line) 422 is in the zigzag shape in which the portion of a sensing unit 20*c* is expanded to be square, and such lines have a layout in which the zigzag patterns of the adjacent signal sending lines or signal receiving lines are interlocked. Also this embodiment is the same as the first embodiment except for the different shape.

As exemplified by the second embodiment, third embodiment and fourth embodiment, the signal sending lines or signal receiving lines can have various shapes in accordance with applications, purposes in use, etc. Besides, the signal sending line and the signal receiving line need not be in the same line shape, but they may well have different line shapes in combination.

Now, the fifth embodiment of the present invention will be described.

Figure 12:
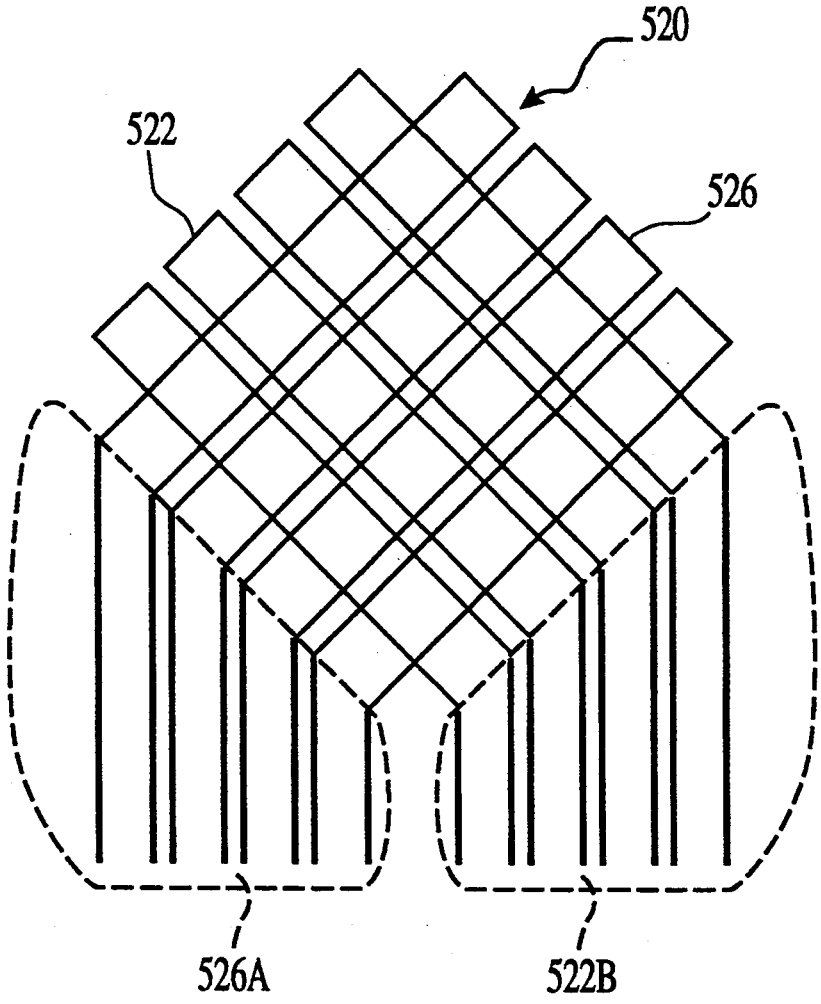
FIG. 12 is a schematic front view showing the configuration of a sensing matrix in the fifth embodiment.

FIG. 12 shows the shape of a sensing matrix in the fifth embodiment. The sensing matrix 520 is so configured that a plurality of signal sending lines 522 and a plurality of signal receiving lines 526 are led unidirectionally (upwards in FIG. 12) and are curved 45 degrees so as to extend in directions intersecting to each other, thereby being laid out in the directions intersecting orthogonally to each other. Also this embodiment is the same as the first embodiment except for the different configuration.

Next, the operation will be described.

In this embodiment, as illustrated in FIG. 12, an area 526A and an area 522B are designed so as to keep a substantially constant pattern length. Therefore, the difference between the total length of the plurality of signal sending lines 522 and that of the plurality of signal receiving lines 526 decreases. As compared with those of the first embodiment, accordingly, the plurality of signal sending lines 522 and the plurality of signal receiving lines 526 have substantially equal D.C. resistances, which can be easily uniformalized among the signal sending lines 522 and among the signal receiving lines 526, with the result that the reaction sensitivity can be uniformalized.

In the above example, the plurality of signal sending lines 522 and the plurality of signal receiving lines 526 have substantially equal D.C. resistances. The D.C. resistances of both the sorts of lines, however, may well differ depending upon the applications, the purposes in use, etc. The sixth embodiment and seventh embodiment of the present invention are such examples.

Figure 13:
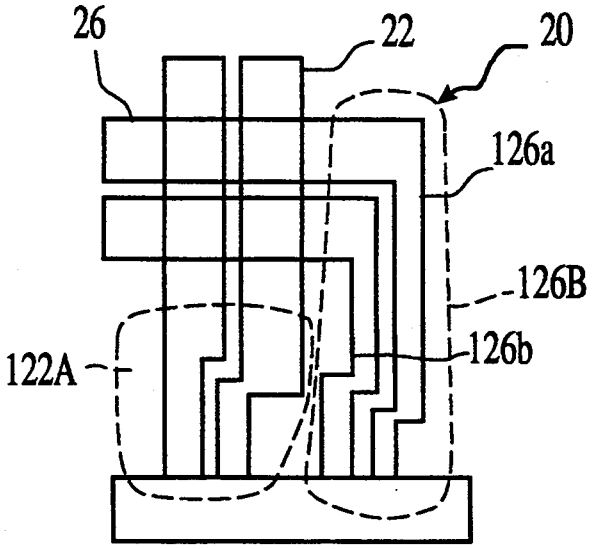
FIG. 13 is a schematic front view showing the configuration of a sensing matrix in the sixth embodiment.

FIG. 13 shows the configuration of a sensing matrix in the sixth embodiment. This embodiment is the same as the first embodiment except for the different configuration.

In this embodiment, pattern lengths in an area 122A and an area 126B are very different. Further, in the area 126B, a line part **126*a* and a line part 126*b* have unequal pattern lengths. Consequently, the plurality of signal sending lines 22 and the plurality of signal receiving lines 26** have discrepancies in their D.C. resistances.

Figure 14:
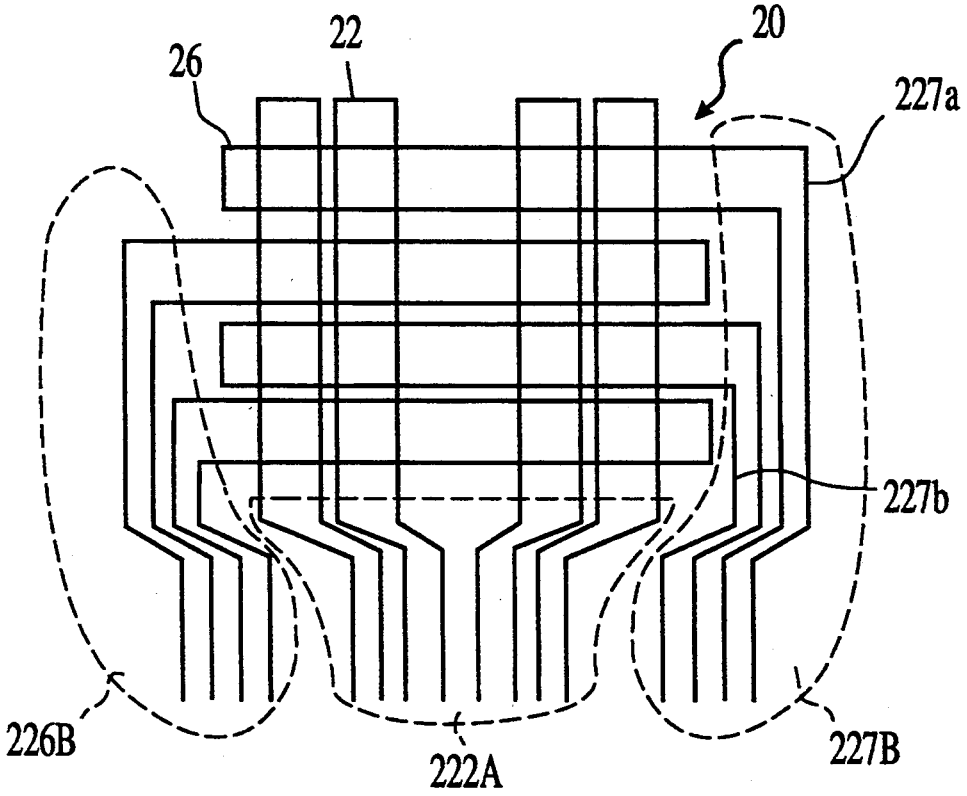
FIG. 14 is a schematic front view showing the configuration of a sensing matrix in the seventh embodiment.

FIG. 14 shows the configuration of a sensing matrix in the seventh embodiment. Also this embodiment is the same as the first embodiment except for the different configuration.

Also in this embodiment, pattern lengths differ in an area 222A, an area 226B and an area 227B, and the pattern lengths of a line part **227*a* and a line part 227*b* are unequal in the area 227B. Consequently, the plurality of signal sending lines 22 and the plurality of signal receiving lines 26** have discrepancies in their D.C. resistances.

In this manner, the sensing matrices can be endowed with various configurations, depending upon the applications, the purposes in use, etc.

Now, the eighth embodiment of the present invention will be described.

Figure 15:
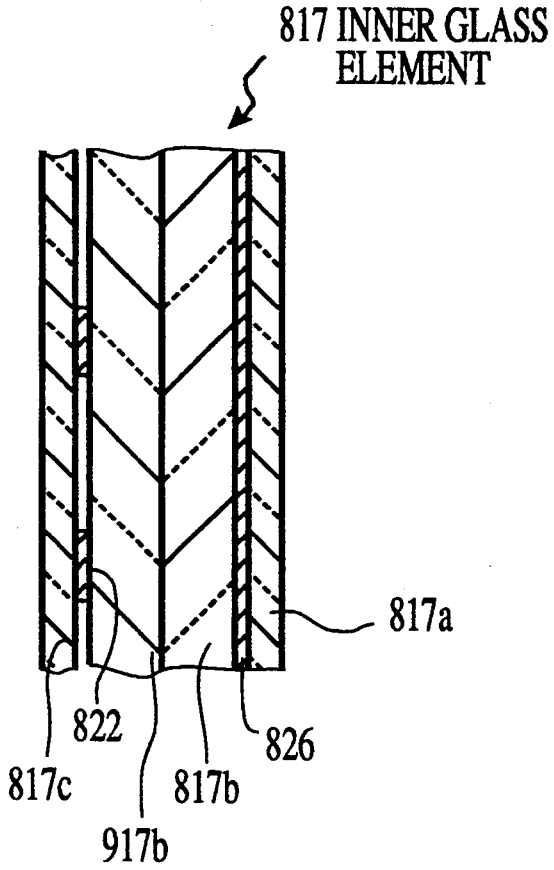
FIG. 15 is an enlarged sectional view of an inner glass element which includes a sensing matrix in the eighth embodiment.

FIG. 15 shows the structure of an inner glass element including a sensing matrix in the eighth embodiment. The inner glass element 817 is so constructed as to stack the four layers of an inner protective glass plate **817*a*, a signal receiving side glass base plate 817*b*, a signal sending side glass base plate 917*b* and an outer glass plate 817*c*. A plurality of signal receiving lines 826 of paralleled folded-back shape, are formed on one surface of the signal receiving side glass base plate 817*b* and have the inner protective glass plate 817*a* stuck thereon. A plurality of signal sending lines 822 of paralleled folded-back shape, are formed on one surface of the signal sending side glass base plate 917*b* and have the outer glass plate 817*c* stuck thereon. In addition, the inner glass element 817 is fabricated in such a way that the base plate surface of the signal receiving side glass base plate 817*b* and the base plate surface of the signal sending side glass base plate 917*b*** are stuck together with a transparent adhesive. The others are the same as in the first embodiment.

In this manner, the inner glass element 817 is fabricated by sticking the two glass base plates **817*b* and 917*b* together, whereby the fabrication of this inner glass element 817** is facilitated.

Incidentally, in this embodiment, the two glass base plates **817*b* and 917*b* may well be replaced with a single glass base plate, both the surfaces of which are patterned to form the signal sending lines 822 of the folded-back shape and the signal receiving lines 826** of the folded-back shape, respectively.

Alternatively, the patterning may well be performed on the surfaces of the inner protective glass plate **817*a* and the outer glass plate 817*c***.

Apart from glass, the base plates **817*b* and 917*b*** may well be made of plastics films.

Now, the ninth embodiment of the present invention will be described.

Figure 16:
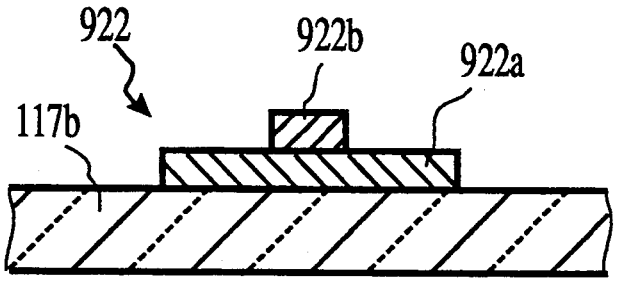
FIG. 16 is an enlarged sectional view of a signal sending line or a signal receiving line in the ninth embodiment.

FIG. 16 shows a signal sending line or a signal receiving line in the ninth embodiment. The signal sending line 922 is manufactured in such a way that a transparent conductor pattern made of an I. T. 0. film **922*a* is formed on one surface of a glass base plate 117*b*, and that a film made of a metal 922*b* such as copper is formed on and along the pattern by evaporation, plating or the like. The I. T. O. film can be formed by a thin-film technique, for example, sputtering. The signal receiving line is similarly manufactured in such a way that a transparent conductor pattern made of an I. T. O. film is formed on the other surface of the glass base plate 117*b***, and that a film of copper is formed on the pattern.

Next, the operation will be described.

Even in a case where the copper pattern of the signal sending line 922 or the signal receiving line has broken, the underlying transparent conductor pattern is kept connected, and hence, the disconnection of the pattern of the signal sending or receiving line can be prevented.

Incidentally, a copper foil may well be stuck with an electrically-conductive adhesive instead of the formation of the copper film on the I. T. O. film.

Although each of the foregoing embodiments has referred to the game machine, the utilization of the sensing matrix is not restricted thereto. The sensing matrix is capable of, for example, the detection of the distribution state of the metal bodies and the detection of the motions of the metal bodies. The utilization of the former makes it possible by way of example to detect whether or not commodities are kept in stock, in such a way that a metal piece of specified pattern is affixed to each of the commodities and that the commodities are arranged in the configuration of the sensing matrix described before. Accordingly, this expedient is applicable to the stock management of commodities. It is also applicable to the management of the quantity of articles by affixing similar metal pieces to the articles. Besides, the sensing matrix can be applied to a sensing apparatus for performing the count, check etc. of the metal bodies at a corner where these metal bodies are exchanged for game prizes.

Now, the tenth embodiment of the present invention will be described.

Figure 17:
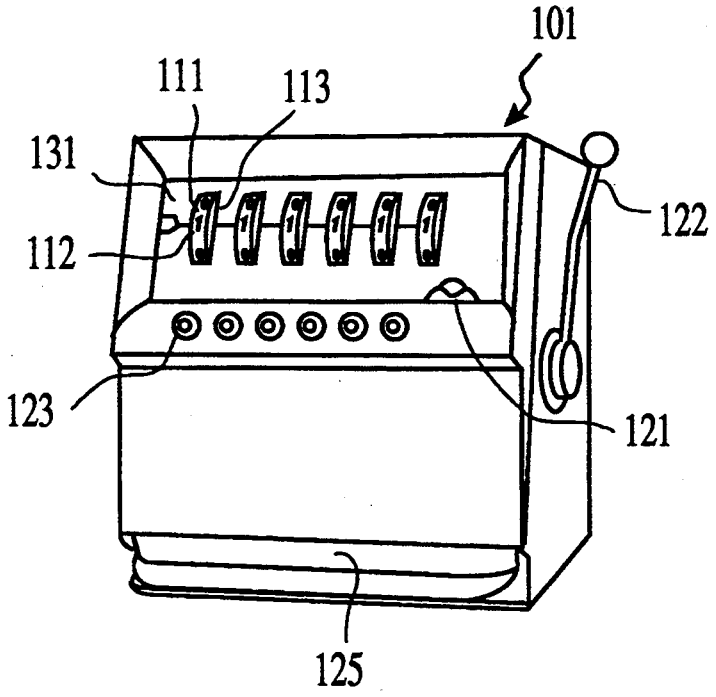
FIG. 17 is a perspective view of a gaming slot machine in the tenth embodiment.

FIG. 17 shows a gaming slot machine in the tenth embodiment. The slot machine 101 is so constructed that the outer peripheral surfaces of six rotators 111 bear a plurality of sorts of common displays 112. A gaming token is inserted into a medal inlet 121, and a handle 122 is pulled toward this side, whereby a game is started in which the individual rotators 111 rotate at high speeds. Subsequently, stop buttons 123 are successively depressed, whereby the rotators 111 corresponding to the buttons are successively stopped.

Thus, any of the plurality of displays is brought to the position of a display window 113 in each of the rotators 111 every game. When all the displays 112 brought to the display windows 113 are predetermined premium-awarding displays, for example, the displays "7", a premium is delivered to a premium outlet 125.

Here, each rotator 111 is formed of a belt or sheet made of a nonconductor such as plastics or rubber, and it is rotated by two belt pulleys not shown. In each rotator 111, a metal such as iron (not shown) is attached to the position of the predetermined premium-awarding display, for example, "7". The display window 113 is covered with a front glass cover 131. The front glass cover 131 has a structure similar to that of the inner glass element 17 in the first embodiment (refer to FIG. 3). The inner glass element 17 includes the sensing matrix 20 constructing the metal sensor. Besides, the sensing matrix 20 constitutes the metal detection apparatus for sensing the metal, in the same manner as in the first embodiment. These, however, shall not be explained further because the explanation is a repetition of that of the first embodiment.

Next, the operation will be described.

When all the displays positioned to the display windows 113 are the predetermined premium-awarding displays, for example, "7" when the rotators 111 are stopped, the sensing matrix 20 senses this state. The positions of the metal sensed by the sensing matrix 20 are transmitted to a built-in CPU, for example, the CPU of the main control device 30 as shown in FIG. 3. Then, when the CPU has acknowledged the predetermined premium-awarding displays, the premium is delivered to the premium outlet 125.

Incidentally, the sensing matrix 20 may well be formed inside the gaming slot machine 101, not at the display windows 113 at the front of the slot machine 101. Besides, the positions of the metal may well be detected by the built-in CPU after the start positions of the rotators 111 have been acknowledged by the sensing matrix 20.

Also in this embodiment, as in the first embodiment, the front glass cover 131 may well be put into the double structure which is composed of the front glass element 16 and the inner glass element 17.

In each of the foregoing embodiments, the sensing matrix can constitute a touch sensor, or a metal pattern discrimination apparatus for discriminating the pattern of metal in, for example, a printed-wiring circuit board.

Moreover, when the sensing matrix is set at an appropriate density, it is also capable of tracking the trajectory of the metal body, whereby the game can also be monitored in detail. The sensing matrix may well be disposed rearward of the panel of the game machine.

Incidentally, the sensing units 20*a*, 20*a*, . . . need not always be square, but they may well have various appropriate shapes.

Apart from the copper, the conductor of which the signal sending lines 22 and the signal receiving lines 26 are made may well be a metal such as aluminum or gold, or a transparent conductor in the form of a film, such as indium oxide or tin oxide.

In addition, each of the foregoing embodiments has referred to the metal sensor in which the plurality of signal sending lines and signal receiving lines constitute the sensing matrix. However, the plurality of signal sending lines or signal receiving lines are not always required, but the sensing matrix may well be formed of a simple configuration composed of a single signal sending line and a single signal receiving line.

Now, the eleventh embodiment of the present invention will be described.

FIGS. 18~30 show the eleventh embodiment of the present invention. Likewise to the first embodiment, the eleventh embodiment illustrates a case where a metal detection apparatus is constructed using a metal sensor and is applied to a game machine.

Figure 18:
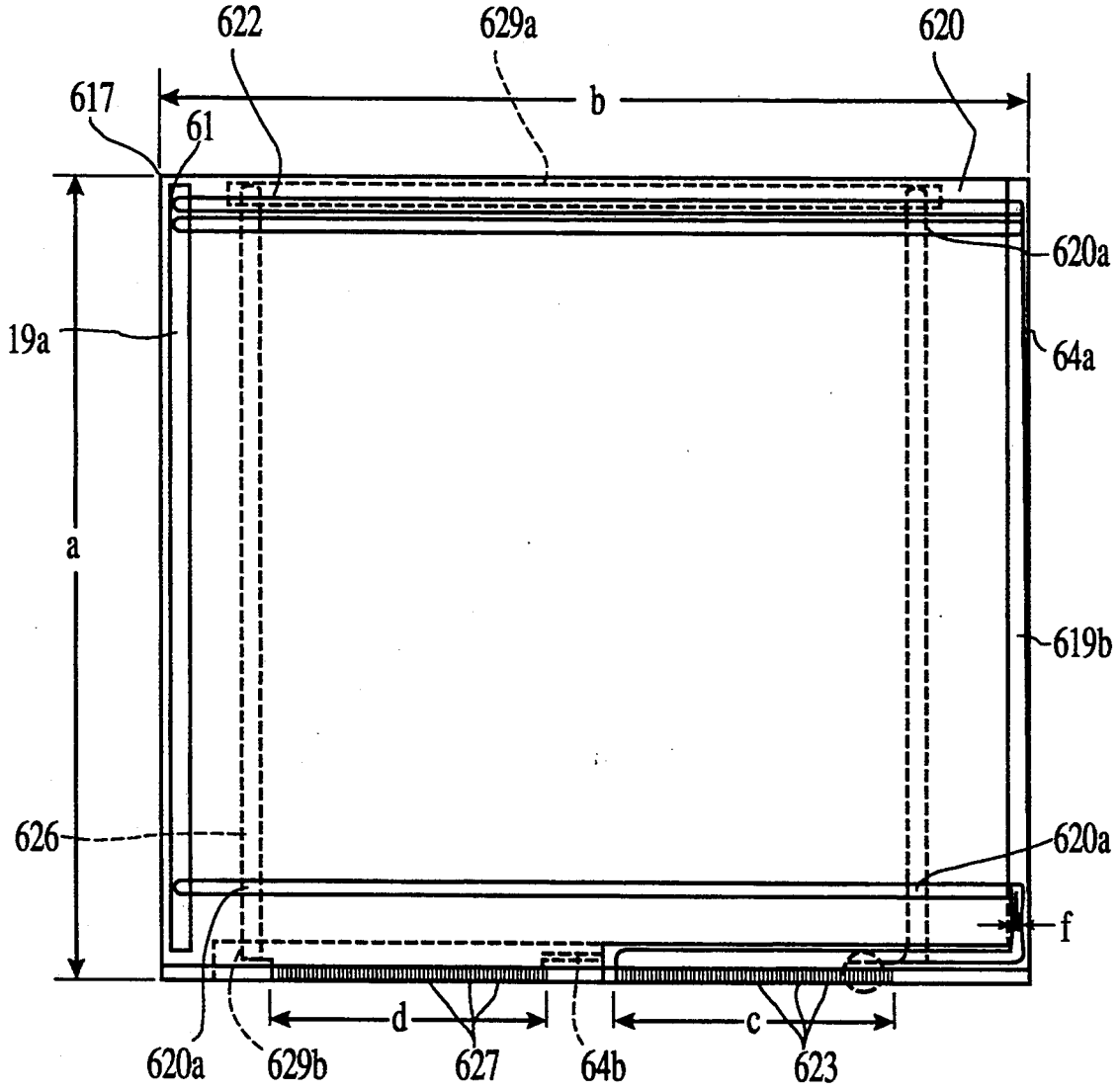
FIG. 18 is a front view of a sensing matrix in the eleventh embodiment of the present invention.

As shown in FIG. 18, a single signal sending line 622 is U-turned at a turning portion 61 into a folded-back shape having a paralleled portion, and a plurality of such signal sending lines 622 are arranged on an identical plane while extending in parallel unidirectionally. Likewise, a single signal receiving line 626 is U-turned into a folded-back shape having a paralleled portion, and a plurality of such signal receiving lines 626 are arranged on an identical plane while extending in parallel unidirectionally. That is, each of the signal sending lines 622 and the signal receiving lines 626 includes the turning portion, and the paralleled portion in which an outward path and a return path are held in parallel. Signal sending terminals 623 and signal receiving terminals 627 are concentratedly arranged at a lower end in relation to an inner glass element (front glass) 617 which is attached to the game machine.

Each signal receiving line 626 is laid close enough to the individual signal sending lines 622 to be electromagnetically coupled with them. The signal receiving lines 626 have their plane held in parallel with the plane of the signal sending lines 622 and are extended in the direction intersecting orthogonally to the extending direction of these lines 622 in order that their electromagnetic characteristics may be changed by the approach of a metal body. The signal sending lines 622 and the signal receiving lines 626 constitute a sensing matrix 620.

Likewise to the sensing matrix in the first embodiment, the sensing matrix 620 shown in FIG. 18 is disposed along the panel of the game machine as shown in FIG. 2. In the front view of FIG. 18, portions of regular square shape, which are respectively enclosed with the signal sending lines 622 and signal receiving lines 626 intersecting with each other, define sensing units 620*a*, 620*a*, . . . each of which is formed so as to sense a magnetic flux generated by the signal sending line, through the signal receiving line and each of which detects a flux change induced by the metal body, thereby finding the existence of this metal body. Some of the sensing units 620a, 620a, . . . correspond to the safe holes 14a, 14a, . . . as shown in FIG. 4. The sensing matrix 620 is provided in the inner glass element (front glass) 617 lying inwards and nearer the panel, of two glass elements which cover the panel as depicted in FIG. 19C.

Figure 19A:
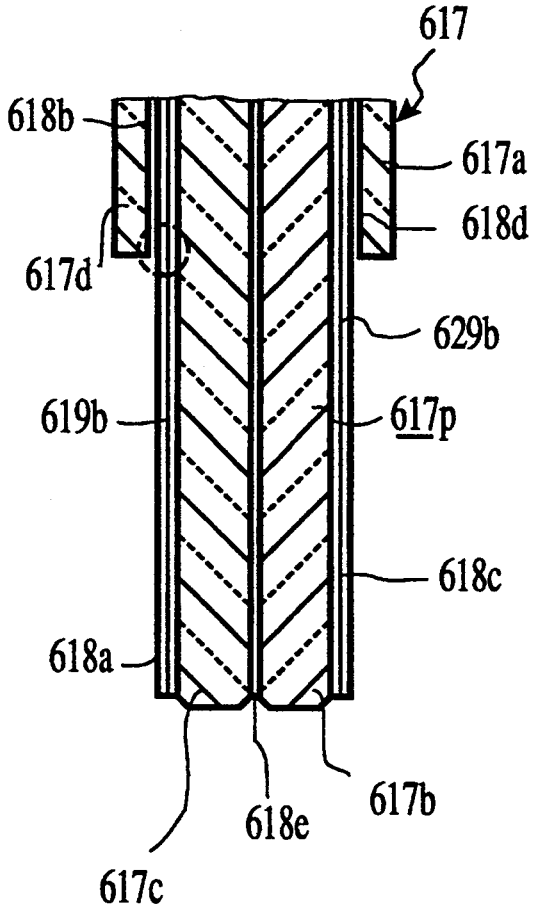
FIGS. 19A, 19B and 19C are enlarged sectional views of an inner glass element which includes the sensing matrix.
Figure 19B:
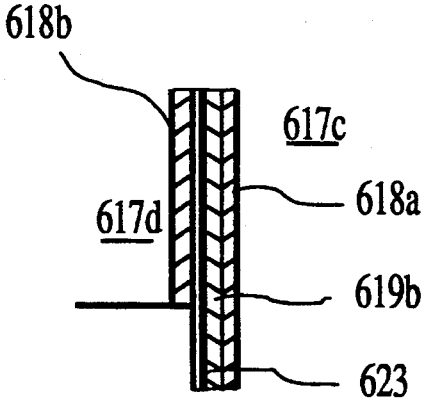
Figure 19C:
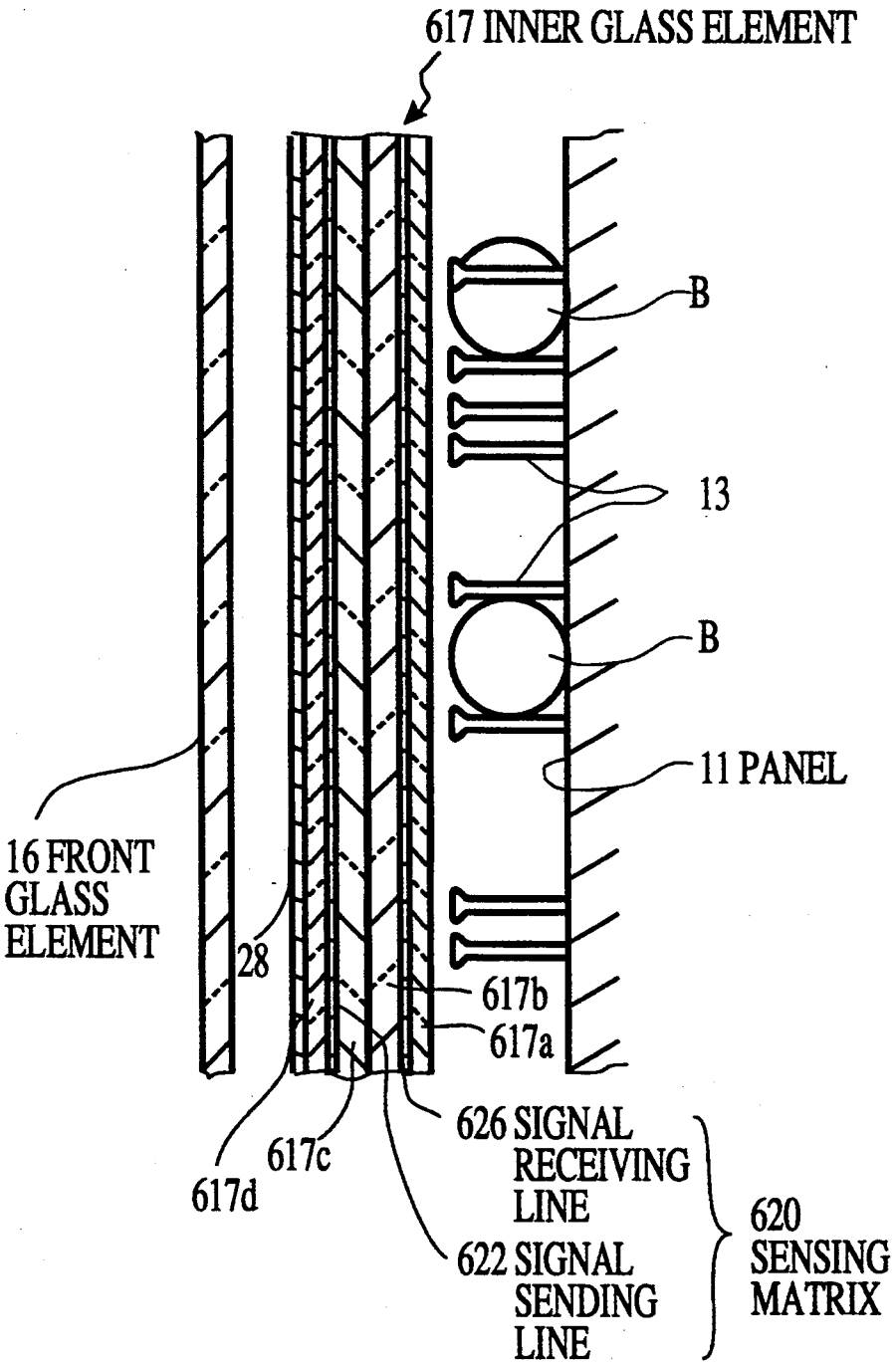

FIG. 19C shows a partial sectional view of the game machine to which this embodiment is applied, FIG. 19A shows an enlarged sectional view of the inner glass element, and FIG. 19B shows an enlarged view of a circular part enclosed with a broken line in FIG. 19A. The inner glass element 617 is constructed by stacking four layers; an inner protective glass plate 617a which is a protective sheet for the signal receiving lines 626 (shown in FIG. 18), a glass base plate 617b on a signal receiving side, a glass base plate 617c on a signal sending side, and an outer glass plate 617d which is a protective sheet for the signal sending lines 622 (shown in FIG. 18). The inner protective glass plate 617a and the outer glass plate 617d are vertically shorter than the signal-receiving-side glass base plate 617b and the signal-sending-side glass base plate 617c and as a result, the inner glass element 617 is exposed at its lower end 617p.

As illustrated in FIG. 19C, the plurality of signal receiving lines 626 in the paralleled folded-back shape (shown in FIG. 18) are laid in a manner so as to be sandwiched in between the inner protective glass plate 617a and the signal-receiving-side glass base plate 617b. The plurality of signal sending lines 622 in the paralleled folded-back shape (shown in FIG. 18) are laid in a manner so as to be sandwiched in between the signal-sending-side glass base plate 617c and the outer glass plate 617d. Accordingly, the inner glass element 617 is fabricated in such a way that the signal sending lines 622 are laid on one surface of the signal-sending-side glass base plate 617c by sticking them with a transparent binder layer 618a, that the outer glass plate 617d is stuck on the signal sending lines with a transparent binder layer 618b, that the signal receiving lines 626 are laid on the other surface of the signal-receiving-side glass base plate 617b by sticking them with a transparent binder layer 618c, that the inner protective glass plate 617a is stuck on the signal receiving lines with a transparent binder layer 618d, and that the other surface of the signal-sending-side glass base plate 617c and the other surface of the signal-receiving-side glass base plate 617b are stuck together by the use of a transparent binder layer 618e.

A transparent conductor film 28 for shielding the sensing matrix is provided on the entire front surface of the outer glass plate 617d lying in front of the plurality of signal sending lines 622. This transparent conductor film is formed of any of an indium-tin oxide (I. T. O.) film, a tin oxide film, etc.

As illustrated in FIG. 18, the signal-sending-side glass base plate 617c in a square shape has a signal-sending-side turning circuit board 619a bonded thereto along one vertical latus thereof, the circuit board 619a being formed of an elongate flexible printed-wiring circuit board (FPC), and it also has a signal-sending-side circumventing circuit board of an L shape 619b bonded thereto along the opposite vertical latus thereof and part of the bottom latus thereof, the circuit board 619b being similarly formed of a flexible printed-wiring circuit board. The signal-sending-side turning circuit board 619a is such that, as shown in FIG. 20, a plurality of arcuate turning portions 61, specifically, 32 of them, are formed in a row by conductor patterns made of copper foil, and that, as shown in FIG. 21, one end 62a of each piece of wire 62 is connected to one end 61a of the corresponding turning portion 61 by welding or soldering with solder 63.

Figure 22:
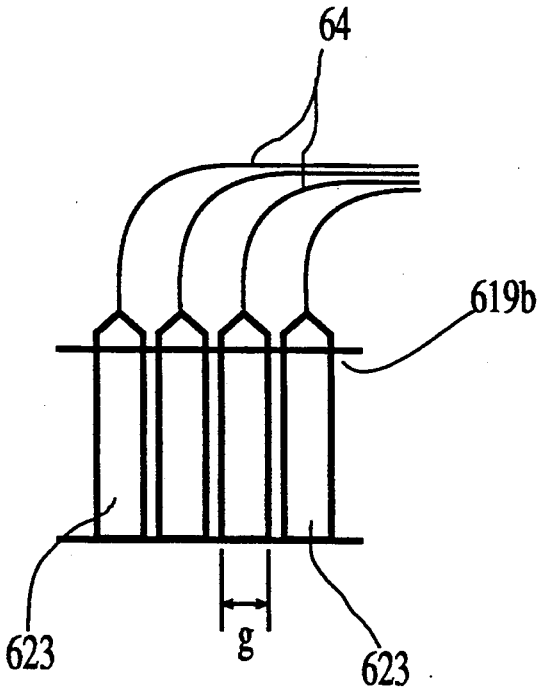
FIG. 22 is an enlarged front view of signal sending terminals.

As depicted in FIG. 18 and in FIG. 22 showing an enlarged view of a circular part enclosed with a broken line in FIG. 18, the signal sending terminals 623 of which there are a plurality, specifically there are 64, and which extend vertically for external connections are formed of conductor patterns made of copper foil, on the lower-end edge of the signal-sending-side circumventing circuit board 619b opposite the turning circuit board and along part of the lower-end latus.

As shown in FIG. 19B, the signal sending terminals 623 are arranged at the lower end 617p of the inner glass element 617 and are exposed due to the fact that they are not concealed by the outer glass plate 617d. That is, the outer glass plate 617d is stuck on the surface part of the signal-sending-side glass base plate 617c bearing the signal sending lines 622, except the part thereof bearing the signal sending terminals 623. On the terminal side of each of the signal sending lines 622, there are the signal sending terminal 623 of the corresponding signal sending line 622 and a circumventive portion 64 for this signal sending terminal 623. The circumventive portions 64 for leading the signal sending lines to the signal sending terminals 623 are formed of conductor patterns on the signal-sending-side circumventing circuit board 619b, and are laid along this signal-sending-side circumventing circuit board 619b from the corresponding signal sending terminals 623.

Figure 20:
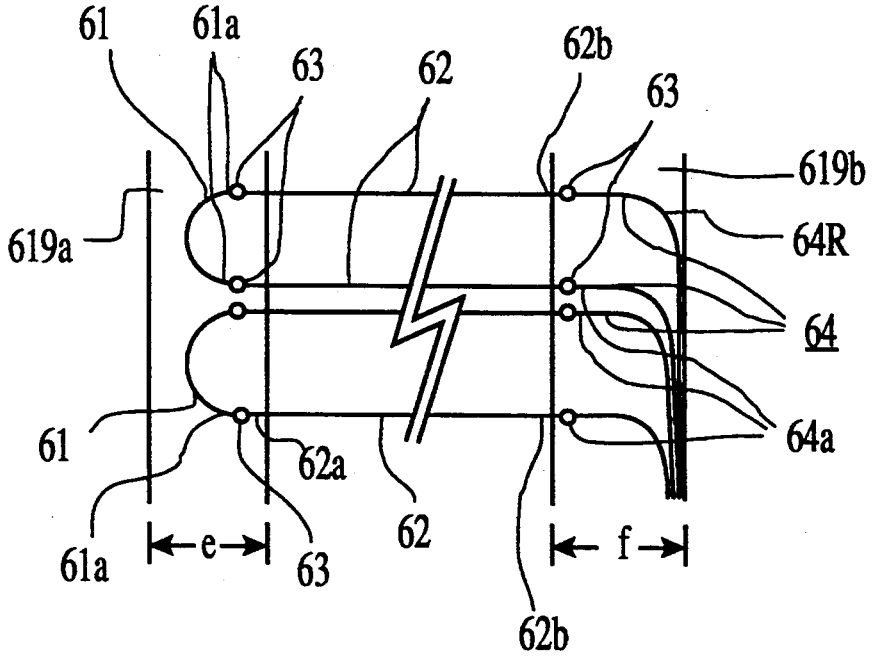
FIG. 20 is an explanatory diagram showing an example of the detailed layout of signal sending lines.
Figure 21:
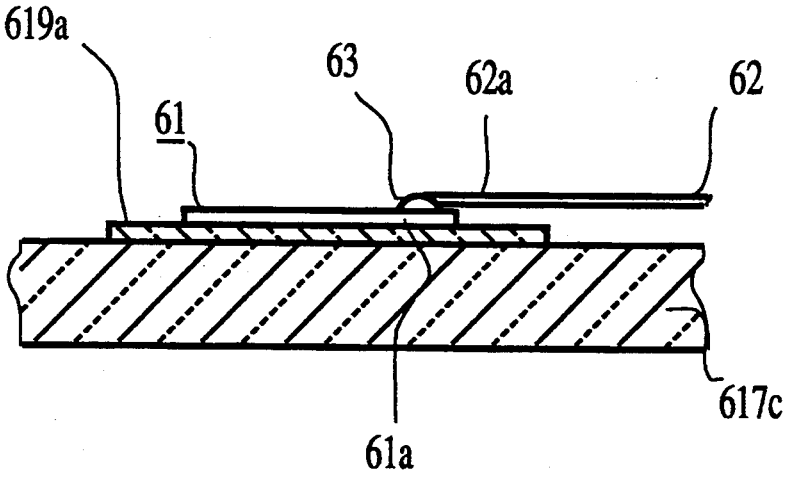
FIG. 21 is an enlarged sectional view of the signal sending line showing the connected state of wire.

Referring to FIG. 20, while being tensed, the wire piece 62 extending from the end 61a of each of the turning portions 61 has its other end 62b connected to the start point 64a of the corresponding circumventive portion 64 on the terminal side by welding or soldering with a solder 63, whereupon the end 62b is connected to the signal sending terminal 623 through the circumventive portion 64. Incidentally, regarding the circumventive portions 64, two straight parts are connected using round parts in order to eliminate any high-frequency problems.

Similarly, the signal-receiving-side glass base plate 617a in a square shape has a signal-receiving-side turning circuit board 629a bonded thereto along one lateral top latus thereof, and it also has an elongate signal-receiving-side circumventing circuit board 629b bonded thereto along part of the lateral bottom latus thereof. Likewise to the signal-sending-side turning circuit board 619a, the signal-receiving-side turning circuit board 629a is such that a plurality of arcuate turning portions 61, specifically, 32 of them, are formed of conductor patterns made of copper foil, and that one end 62a of each piece of wire 62 is connected to one end 61a of the corresponding turning portion by welding or soldering with solder 63.

The plurality of signal receiving terminals 627, specifically, 64 of them, which extend vertically for external connections are formed of conductor patterns made of copper foil, on the lower-end edge of the signal-receiving-side circumventing circuit board 629b opposite the turning circuit board and along part of the lower-end latus. These signal receiving terminals are located at non-confronting positions at which they do not overlap the signal sending terminals when the signal-receiving-side glass base plate 617b is stuck to the signal-sending-side glass base plate 617c.

As shown in FIG. 19A, the signal receiving terminals 627 are arranged at the lower end 617p of the inner glass element 617 and are exposed due to the fact that they are not concealed by the inner protective glass plate 617*a*. That is, the inner protective glass plate 617*a* is stuck on the surface part of the signal-receiving-side glass base plate 617*b* bearing the signal receiving lines 626, except the part thereof bearing the signal receiving terminals 627. On the terminal side of each of the signal receiving lines 626, there are the signal receiving terminal 627 of the corresponding signal receiving line 621 and a circumventive portion 64 for this signal receiving terminal 627. The circumventive portions 64 for leading the signal receiving lines to the signal receiving terminals 627 are formed of conductor patterns on the signal-receiving-side circumventing circuit board 629*b*, and are laid along this signal-receiving-side circumventing circuit board 629*b* from the corresponding signal receiving terminals 627.

While being tensed, the wire piece 62 extending from the end 61*a* of each of the turning portions 61 has its other end 62*b* connected to the start point 64*a* of the corresponding circumventive portion 64 on the terminal side by welding or soldering with solder 63, whereupon the end 62*b* is connected to the signal receiving terminal 627 through the circumventive portion 64.

In this manner, each of the signal sending lines 622 or the signal receiving lines 626 is made up of the turning portion 61 which is formed on the corresponding turning circuit board 619*a* or 629*a*, the circumventive portions 64 which are formed on the corresponding circumventing circuit board 619*b* or 629*b*, the wire pieces 62, and the signal sending terminal 623 which forms the end part of the signal sending line 622 or the signal receiving terminal 627 which forms the end part of the signal receiving line 626. Incidentally, the surface of each wire piece 62 has a delustered black color and prevents the reflection of light in order to be inoffensive to the game player's eye.

The pattern of the sensing matrix 620 suitable for the ordinary game machine 10 is one which has the signal sending lines 622 in 32 rows and the signal receiving lines 626 in 32 columns, so that there are a total of 1024 sensing units 620*a*. Incidentally, in FIG. 18, the pattern except the outer part thereof is omitted from illustration.

The diameter of the wire of which each of the signal sending lines 622 and signal receiving lines 626 is formed is preferably set at a value of 25 $\mu$m~30 $\mu$m. In the case of this embodiment, the entire widths c and d of the signal sending terminals 623 and signal receiving terminals 627 as indicated in FIG. 18 are respectively set at 126 mm, and the widths e and f of the vertically-extending parts of the signal-sending-side turning circuit board 619*a* and signal-sending-side circumventing circuit board 619*b* as indicated in FIG. 20 are respectively set at 10 mm or less.

Besides, the width g of each of the signal sending terminals 623 and signal receiving terminals 627 as indicated in FIG. 22 is 1.5 mm. Owing to the fact that the widths e and f of the circumventive portions 64 are set at 10 mm or less, the signal-sending-side turning circuit board 619*a* and the signal-sending-side circumventing circuit board 619*b* are hidden by a mounting frame for the inner glass element (front glass) 617 of the game machine and cannot be seen from the front side where the game player stands.

Figure 23:
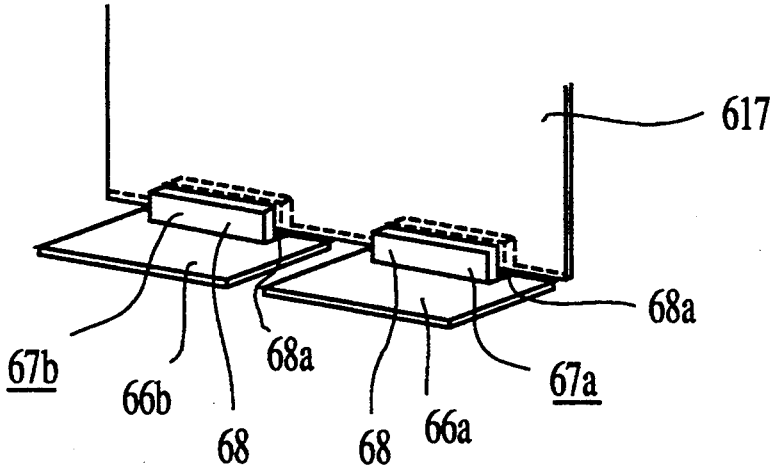
FIG. 23 is a perspective view showing the state in which the inner glass element is connected to a signal sending connector and a signal receiving connector.

As shown in FIG. 23, a signal sending circuit board 66*a* and a signal receiving circuit board 66*b* are installed at the inner lower part of the mounting frame. The signal sending circuit board 66*a* is provided with a signal sending circuit 640 for sending signals to the plurality of signal sending lines 622 of the sensing matrix 620, while the signal receiving circuit board 66*b* is provided with a signal receiving circuit 650 for receiving signals from the plurality of signal receiving lines 626. A signal sending connector 67*a* and a signal receiving connector 67*b* are respectively mounted on those positions of the circuit boards 66*a* and 66*b* which correspond to the signal sending terminals 623 and the signal receiving terminals 627.

The signal sending connector 67*a* is an edge connector for detachably connecting the signal sending terminals 623 to the signal sending circuit 640 on the signal sending circuit board 66*a*, while the signal receiving connector 67*b* is an edge connector for detachably connecting the signal receiving terminals 627 to the signal receiving circuit 650 on the signal receiving circuit board 66*b*. More specifically, the signal sending connector 67*a* or signal receiving connector 67*b* is so constructed that the upper part of an elongate insulator member 68 extending along the signal sending circuit board 66*a* or signal receiving circuit board 66*b* is formed with a slit 68*a* in the lengthwise direction of the insulator member, and that a large number of electrically-conductive rubber pieces connecting to the corresponding circuit board 66*a* or 66*b* are packed in the bottom of the slit 68*a* in a direction perpendicular to the circuit board 66*a* or 66*b*.

The inner glass element (front glass) 617 in which the signal sending terminals 623 and the signal receiving terminals 627 are arranged, can be inserted into the slits 68*a* of the insulator members 68. The signal sending connector 67*a* is connected with the signal sending terminals 623 of the signal sending lines 622 in the state in which the inner glass element 617 is held between both the inner surfaces of this connector, while the signal receiving connector 67*b* is connected with the signal receiving terminals 627 of the signal receiving lines 626 in the same manner.

The signal sending terminals 623 and signal receiving terminals 627 are respectively connected with the signal sending circuit 640 and signal receiving circuit 650 as follows: The signal sending terminals 623 and signal receiving terminals 627 are positioned under the inner glass element 617 and are inserted into the corresponding slits 68*a* so as to be able to connect with the signal sending connector 67*a* and signal receiving connector 67*b*, and the resulting inner glass element 617 is fitted in the mounting frame so that the signal sending terminals 623 and signal receiving terminals 627 may be reliably connected with the signal sending connector 67*a* and signal receiving connector 67*b* by the weight of the element 617, which is about 1.2 kg.

A signal processing system which constitutes the metal detection apparatus for sensing the metal body, is as shown in FIGS. 24~28.

Figure 24:
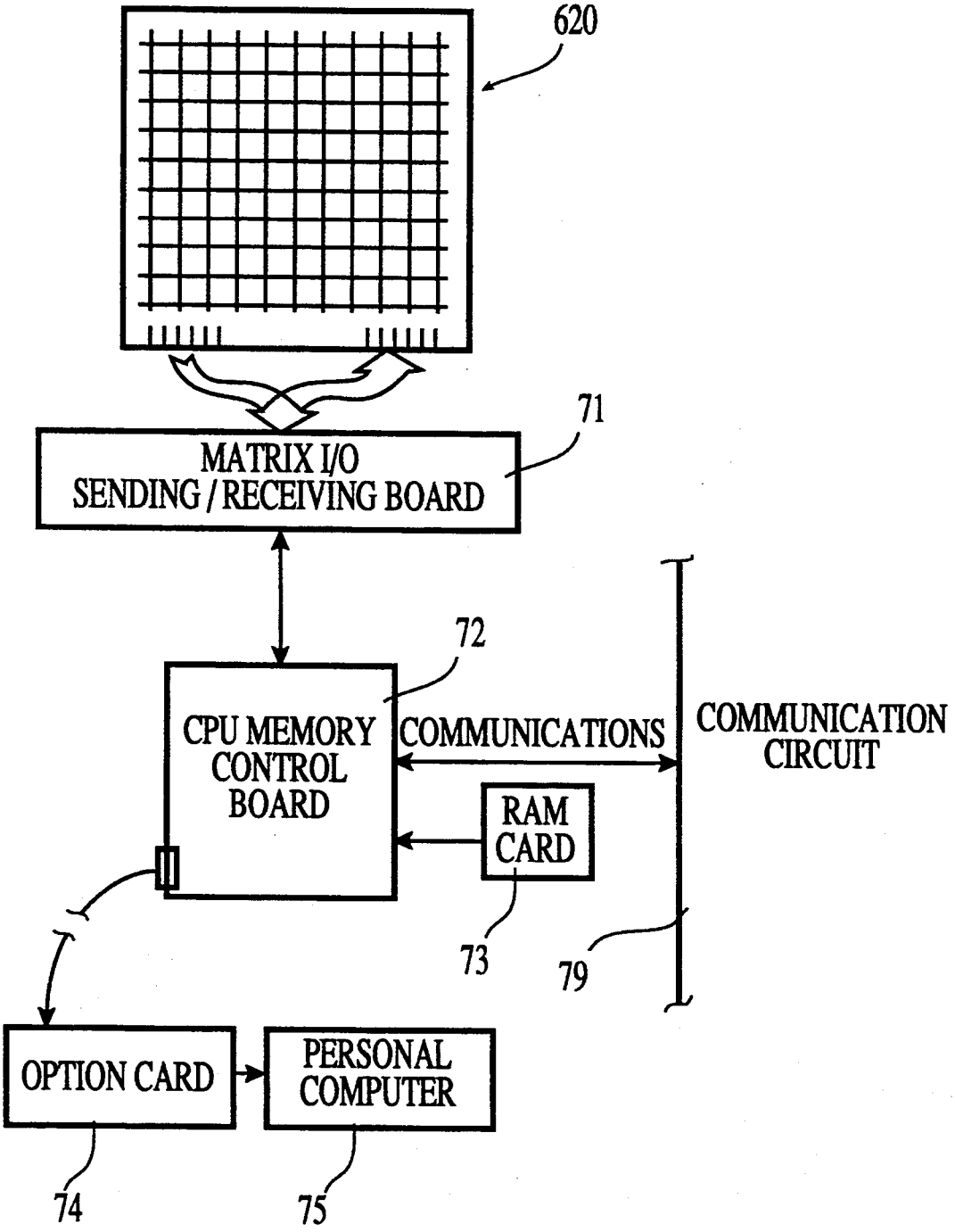
FIG. 24 is a general block diagram of a metal detection apparatus.

As illustrated in FIG. 24, the sensing matrix 620 is under the control of a CPU memory control board 72 through a matrix I/O sending/receiving board 71. The CPU memory control board 72 is capable of communication by means of a communication circuit 79. Besides, the CPU memory control board 72 can read and utilize the data of a RAM card 73. This CPU memory control board 72 has a central processing unit (CPU), a main memory, an interface function unit, packaged therein, whereby a computer is, in effect, constructed.

The RAM card 73 stores therein the data of the positions of safe holes 14*a* and algorithm for detecting the metal ball entering any of the safe holes 14*a*.

The CPU memory control board 72 is also capable of recording data in an option card 74. The trace of the metal body can be displayed and printed in such a way that the data recorded in the option card 74 is processed by a computer 75 prepared outside.

The option card 74 to be connected to the CPU memory control board 72 is means for recording the traces of the metal bodies which move about in the interspace between the panel 11 and inner glass element 617 of the game machine 10. One aspect of the option card 74 is a system in which the data is stored in a semiconductor memory or the like. Besides, in a time zone in which the number of the game players increases, the activity rate of each game machine 10 heightens, and hence, an enormous storage capacity is required. In this regard, since the semiconductor memory requiring the enormous storage capacity is usually expensive or in need of a larger space, the motions of the metal bodies may well be recorded using a hard disk. The recorded data is applied to, and arithmetically processed by, the computer in which the software for analyzing the traces of the metal bodies is set, whereby data needed in a game center or the like can be obtained.

The matrix I/O sending/receiving board 71 includes the signal sending circuit board 66*a* provided with the signal sending circuit 640, and the signal receiving circuit board 66*b* provided with the signal receiving circuit 650. The signal sending circuit 640 is a circuit which sends signals of predetermined frequency to the individual signal sending lines 622 sequentially, while the signal receiving circuit 650 is a circuit which receives signals from the individual signal receiving lines 626 sequentially in synchronism with the signal sending circuit 640.

Figure 25:
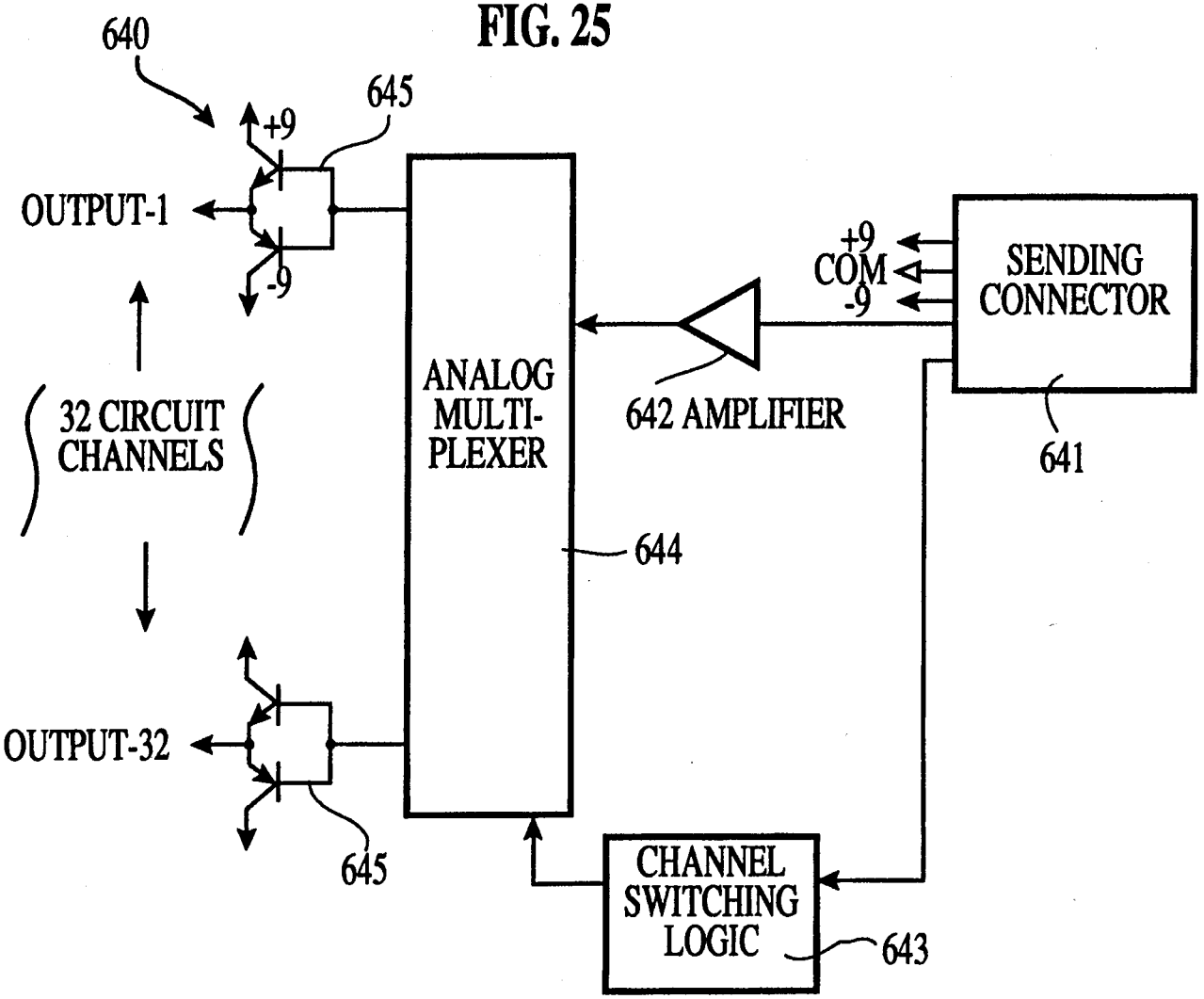
FIG. 25 is a block diagram of a signal sending circuit in a matrix I/O sending/receiving board.

As shown in FIG. 25, the signal sending circuit 640 is configured of a signal sending connector 641, an amplifier 642 and channel switching logic 643 which are connected to the signal sending connector 641, an analog multiplexer 644 which is connected to both the amplifier 642 and the channel switching logic 643, and 32 totem-pole drivers of PNP and NPN transistors 645 which are all connected to the analog multiplexer 644 and which are respectively connected through the signal sending connector 67*a* to the signal sending lines 622 in the plural circuit channels, specifically, 32 circuit channels.

Figure 26:
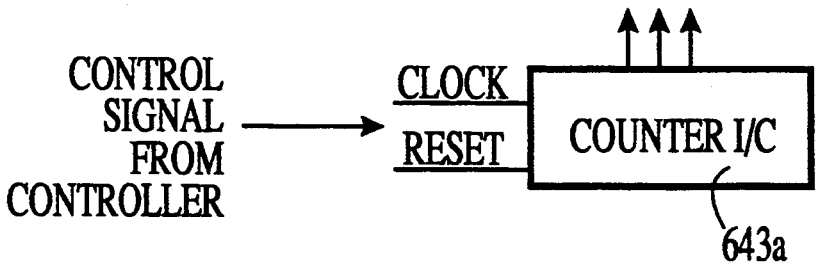
FIG. 26 is a block diagram showing the principal part of a channel switching logic.

As shown in FIG. 26, the channel switching logic 643 is operated with two, clocking and resetting control signals by effectively utilizing a counter IC 643*a*.

Figure 27:
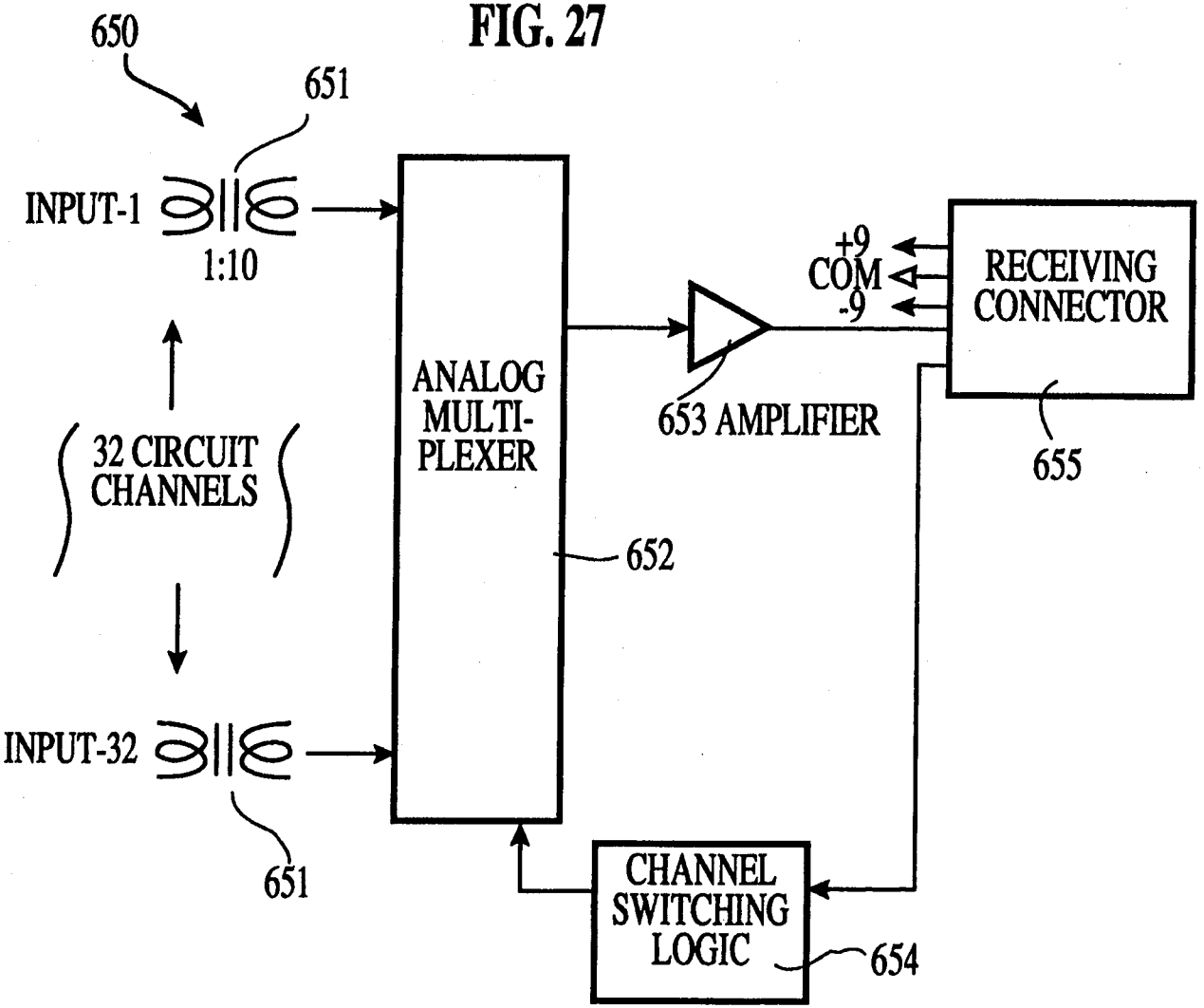
FIG. 27 is a block diagram of a signal receiving circuit in the matrix I/O sending/receiving board.

As shown in FIG. 27, the signal receiving circuit 650 is configured of 32 CT sensors (current transformers) 651 which are respectively connected through the signal receiving connector 67*b* to the signal receiving lines 626 in the plural circuit channels, specifically, 32 circuit channels, an analog multiplexer 652 which is connected to the CT sensors 651, an amplifier 653 and channel switching logic 654 which are connected to the analog multiplexer 652, and a signal receiving connector 655 which is connected to both the amplifier 653 and the channel switching logic 654. Each of the CT sensors 651 isolates the corresponding signal receiving line 626 from the analog multiplexer 652, and amplifies a signal from the signal receiving line 626 by 10 times. The channel switching logic 654 is a component which is similar to the channel switching logic 643 of the signal sending circuit 640.

Figure 28:
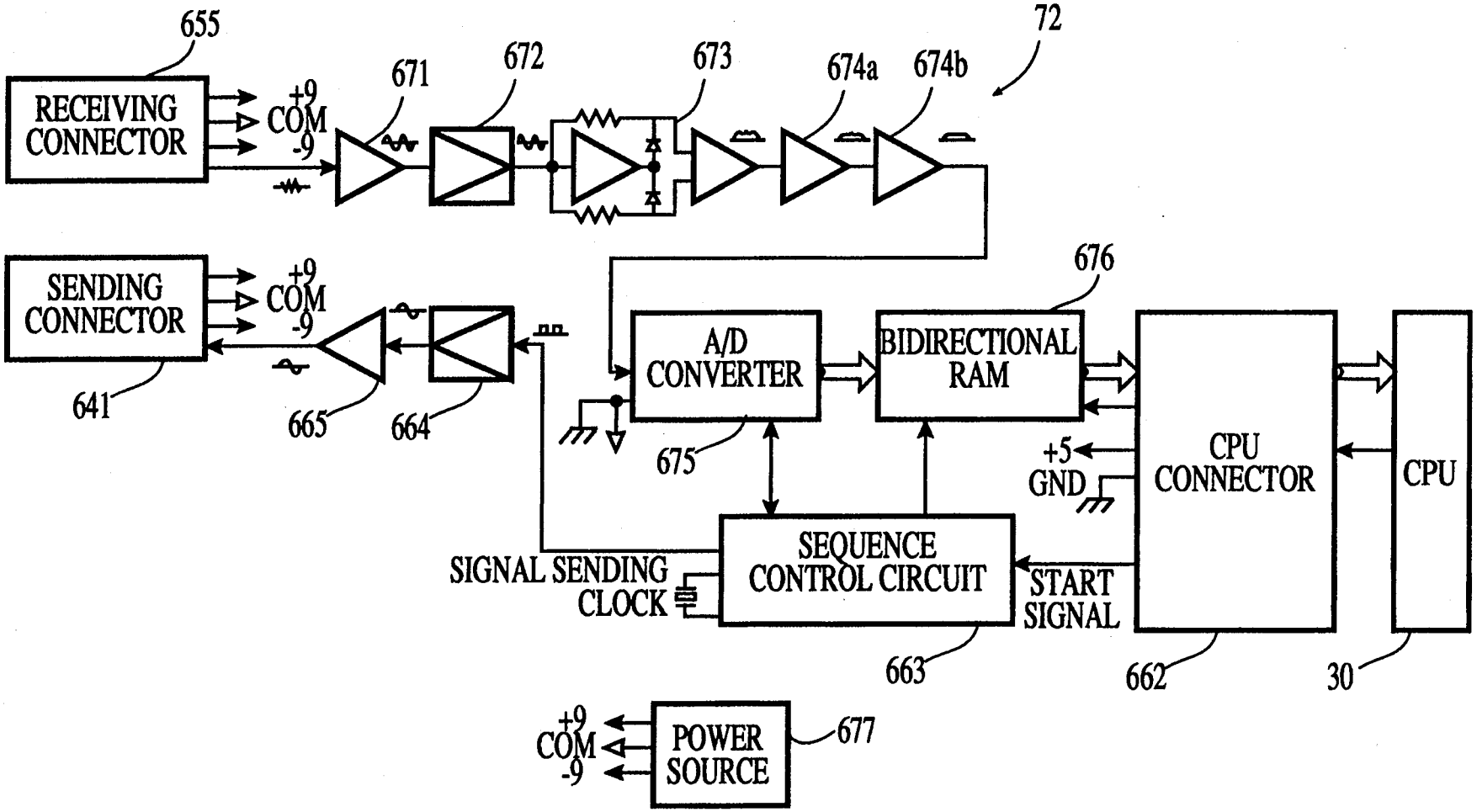
FIG. 28 is a block diagram of signal receiving and signal sending circuits in a CPU memory control board.

As shown in FIG. 28, the CPU memory control board 72 is furnished on the signal sending side thereof with a CPU connector 662 which is connected to a CPU (not shown), a sequence control circuit 663 which produces signal sending clock pulses in response to a start signal applied through the CPU connector 662 by the CPU, a band-pass filter 664 which accepts the signal sending clock pulses and delivers signals to-be-sent, and an amplifier 665 which amplifies the signals to-be-sent and delivers the amplified signals to the signal sending connector.

In addition, the CPU memory control board 72 is furnished on the signal receiving side thereof with an amplifier 671 which amplifies received signals from the signal receiving connector 655, a band-pass filter 672 which accepts the amplified signals, a full-wave rectifier/amplifier 673 which accepts the received signals from the band-pass filter 672, two stages of low-pass filters 674*a* and 674*b* which accept the received signals from the full-wave rectifier/amplifier 673, an A/D converter 675 which accepts the received signals from the low-pass filter 674*b* and delivers digital data to a bidirectional RAM 676 under the control of the sequence control circuit 663, and the bidirectional RAM 676 which accepts the digital data, writes the received data under the control of the sequence control circuit 663 and delivers the received data to the CPU through the CPU connector 662 in response to a read signal from this CPU connector 662.

The bidirectional RAM 676 includes therein a counter, which executes all the processing of the matrix data of the metal bodies. Further, the CPU memory control board 72 is furnished with a power source unit 677.

Suitable as a voltage waveform 81 to be applied to the signal sending lines 622 is a continuous sinusoidal wave which has a frequency of 1~1.3 MHz and which centers at 0 V.

The game machines 10 develop noise at various frequencies, depending upon the types thereof. When the frequency of the noise is identical with or close to the frequency of the signals sent to the sensing matrix 620, the accuracy of detection of the metal body deteriorates drastically. Accordingly, several sorts of metal detection apparatuses whose signal sending frequencies are not identical with or close to the frequencies of the noise in the frequency band of 1~1.3 MHz are prepared beforehand in accordance with the types of the game machines 10, and the metal detection apparatus of the appropriate signal sending frequency is selected and mounted in conformity with the game machine 10 to-be-installed. According to this expedient, the detection accuracy for the metal body can be raised by eliminating the influence of the noise at a low cost of fabrication. Moreover, when the metal detection apparatus of the sort most suited to the game machine 10 is selected in advance, the application thereof to the game machine 10 is facilitated.

Next, the operation of this embodiment will be described.

Address signals and control signals from the CPU are transmitted to the game machine 10 via the CPU connector 662 in the same manner as in the first embodiment.

In the game machine 10, on the signal sending side, the sequence control circuit 663 accepts the start signal and divides the frequency of a crystal oscillation clock at a value of 16 MHz as is needed, thereby delivering the signal sending clock. The signal sending clock from the sequence control circuit 663 is subjected to waveshaping from the digital signal into the analog signal by the band-pass filter 664. Thereafter, the analog signal is amplified by the amplifier 665 and is delivered to the signal sending connector 641.

Further, the sending signal is amplified by the amplifier 642 in the signal sending circuit 640. The analog multiplexer 644 actuates the totem-pole drivers 645 sequentially in the channels changed-over by the channel switching logic 643. Thus, the totem-pole drivers 645 deliver the signals amplified by the amplifier 642, to the signal sending lines 622 sequentially at predetermined cycles (refer to a step 691 in FIG. 29).

Figure 29:
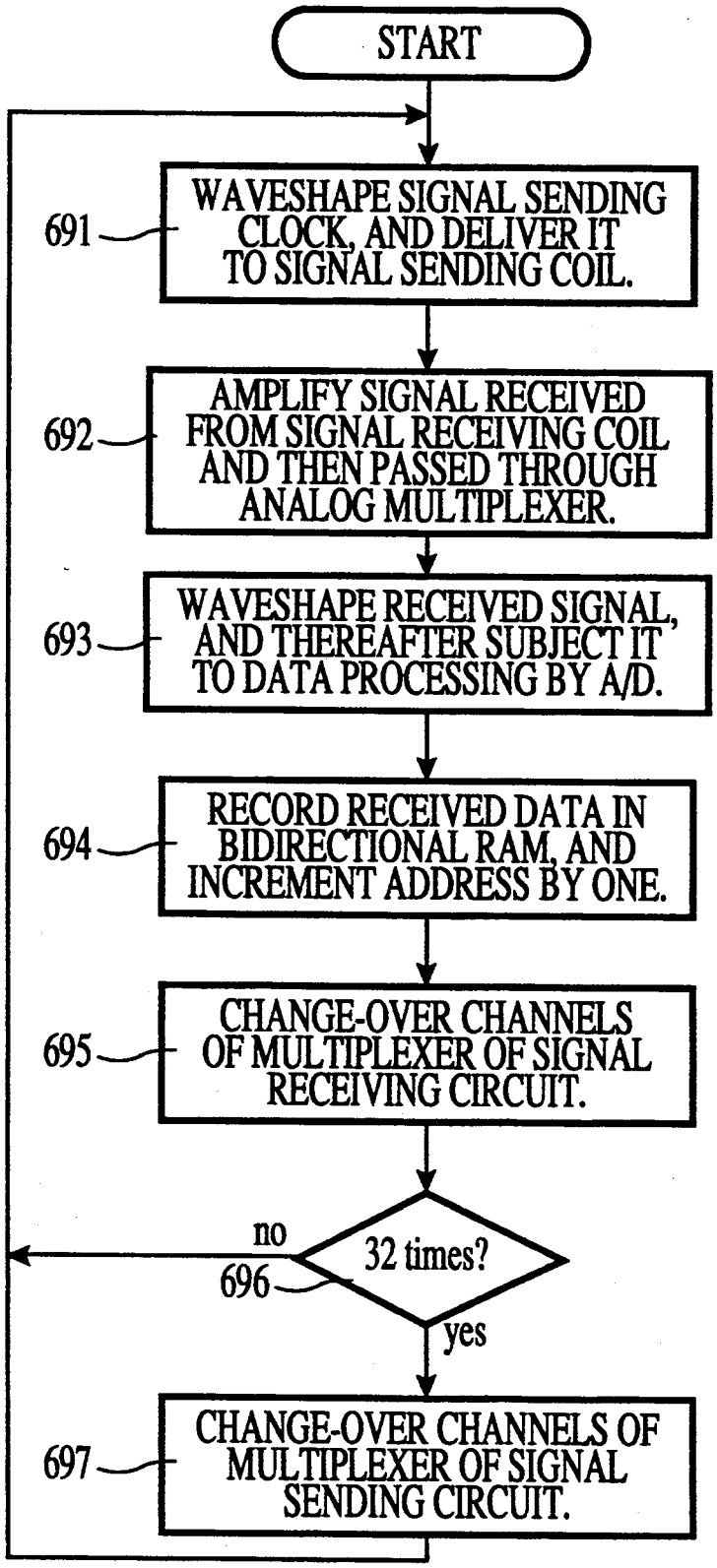
FIG. 29 is a flow chart of the scanning of the sensing matrix.

On the signal receiving side, as indicated in FIG. 29, currents being electromagnetic characteristic values which appear on the plurality of signal receiving lines 626 are amplified by 10 times by means of the CT sensors 651. Since the CT sensors 651 are employed for the amplification, the gain of the amplifier on the signal receiving side need not be heightened accordingly. Since the amplification by the CT sensors 651 proceeds with the corresponding signal receiving lines 626 isolated from the analog multiplexer 652, it can be effected without developing noise. Thus, in contrast to a case of employing OP (operational) amplifiers, this embodiment can prevent the occurrence of noise and D.C. drifts ascribable to the OP amplifiers themselves, and the accuracy of detection for the received signals can be enhanced. The adoption of the CT sensors 651 dispenses with the use of the OP amplifiers being usually larger in size than the CT sensors, and permits a reduction in the size of the matrix I/O sending/receiving board 71.

The analog multiplexer 652 is a circuit in which the signals accepted from the individual signal receiving lines 626 via the CT sensors 651 are changed-over in accordance with the channel switching logic 654 and then delivered sequentially at predetermined cycles. The signals from the analog multiplexer 652 are amplified by 100 times by means of the amplifier 653 (refer to a step 692 in FIG. 29).

Figure 30A:
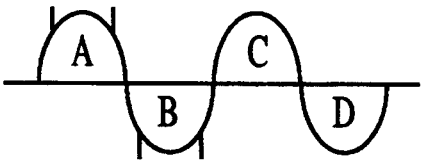
FIGS. 30A, 30B, 30C and 30D are waveform diagrams showing the signal processing of a received signal.
Figure 30B:
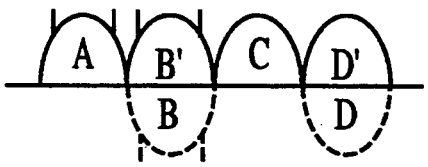

Each of the received signals is amplified and detected via the signal receiving connector 655, amplifier 671 and band-pass filter 672. As shown in FIG. 30A, the received signal from the band-pass filter 672 is an analog signal which has several cycles as one scan. The analog signal is waveshaped as shown in FIG. 30B by the full-wave rectifier/amplifier 673.

Figure 30C:
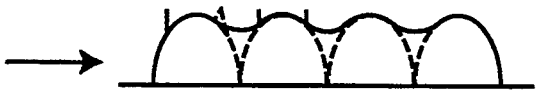
Figure 30D:
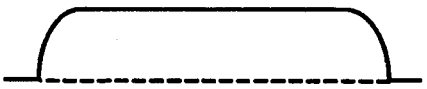

The signal from the full-wave rectifier/amplifier 673 is averaged by integration processing as shown in FIG. 30C by means of the low-pass filter 674*a*, and the resulting signal is further averaged as shown in FIG. 30D by means of the low-pass filter 674*b*. Thus, noise is also averaged together with the received signal. Since, however, the magnitude of the noise is very slight compared with that of the signal, an error ascribable to the noise is negligible. The reason therefor is that, in averaging the received signal by means of the low-pass filters 674*a* and 674*b*, this signal has already passed through the band-pass filter 672, so noise intense enough to incur an appreciable error is not involved. For the purpose of avoiding the error, the signal sending frequency is selected to be the frequency which is not affected by the noise of the game machine 10, and a filter suited to the signal sending frequency is employed as the band-pass filter 672.

Subsequently, the received signal is delivered to the A/D converter 675. The A/D converter 675 converts the signal from the sensing matrix 620 into a digital signal of a predetermined number of bits, for example, a 12-bit unit, and it records the received data in the bidirectional RAM 676 under the control of the sequence control circuit 676 (refer to a step 693 in FIG. 29). The speed of this processing is as high as 25000 times per second. After the bidirectional RAM 676 has recorded the received data irrespective of the operation of the CPU 30 in response to a write signal delivered from the sequence control circuit 676, it increments the address by one upon inputting one clock pulse (refer to a step 694 in FIG. 29). The capacity of the bidirectional RAM 676 is, for example, 2048 bytes.

In this way, the analog multiplexer 652 of the signal receiving circuit 650 changes-over the signals from the individual signal receiving lines 626 (refer to a step 695 in FIG. 29) until the above steps are repeated 32 times in correspondence with the 32 signal receiving lines 626 (refer to a step 696 in FIG. 29). After the steps have been repeated 32 times, the analog multiplexer 644 of the signal sending circuit 640 changes-over the signal sending lines 622 (refer to a step 697 in FIG. 29), whereupon the signal processing is repeated again.

The CPU issues the read start signal when it is needed so as to read out and arithmetically process the data on the positions of the metal bodies recorded in the bidirectional RAM 676. In addition, the CPU repeats this processing. The CPU and the circuits of the CPU memory control board 72 execute the processing while neglecting wait times for each other, so that the burden of the CPU 30 can be relieved to heighten the processing speed of this CPU 30.

Incidentally, regarding the CPU 30, when the algorithm for detecting the ball is simple, the use of an inexpensive 8-bit CPU suffices, and when the required algorithm is complicated, a 16-bit CPU may well be selected for executing high-speed processing. In either case, the rate of the scanning of the metal body is not affected by the CPU because the CPU is not concerned in the scanning.

In this manner, in the case where the current is caused to flow through the signal sending line 622 in the folded-back shape so as to generate a magnetic field and where an electromotive force is generated by the mutual induction in the signal receiving line 626 which is electromagnetically coupled with the signal sending line 622, an eddy current is produced in the surface of the metal body and in the direction of canceling a magnetic flux based on the sensing matrix 620 when the metal body comes near the sensing unit 620*a*. Then, the magnitude of an induced current appearing in the signal receiving line 626 changes at the pertinent position. The signal sending lines 622 and the signal receiving lines 626 corresponding thereto on such occasions can be detected by the scanning operations as stated above.

Accordingly, the positions of the metal bodies can be grasped as the coordinates of the positions where the signal receiving lines 626 whose impedances have changed intersect with the associated signal sending lines 622. The total number of the sensing units 620*a* is 1024 in conformity with the signal sending lines 622 in the 32 rows and the signal receiving lines 626 in the 32 columns. Therefore, no matter which of the safe holes 14*a* and the out hole 15 in the panel 611 the metal body may pass through, it can be detected.

Incidentally, since the voltage waveform 81 for the signal sending lines 622 is the continuous sinusoidal wave centering at 0 V, noise as in the case of a square wave does not develop, and detrimental effects on the other devices such as the CPU can be prevented.

Moreover, since the voltage waveform 81 is at 1~1.3 MHz in terms of the signal sending frequency band, it can heighten a reaction sensitivity besides being less susceptible to the noise arriving from the peripheral equipment of the game machine 10. Incidentally, the components capable of processing the signals in the frequency band of 1~1.3 MHz are less expensive than components for processing signals in a higher frequency band. In addition, the signal detection apparatus at the signal sending frequency which is not identical with or close to the frequency of the noise of the game machine 10 is selected in accordance with the type of this game machine, so that a favorable detection accuracy for the metal body can be attained without being affected by the noise.

Further, the inner protective glass plate 617*a* and the outer glass plate 617*c* protect the signal sending lines 622 and the signal receiving lines 626 from physical damage caused by shocks, e.g. from dust, and from corrosion ascribable to oxidation etc., so that the durability of the sensing matrix 620 can be enhanced to prolong the lifetime thereof.

Still further, the transparent conductor film 28 on the front surface of the outer glass plate 617*d* shields the sensing matrix against the external electrical influences of metals and dielectrics, and it also functions to heighten the reaction sensitivity to the metal body.

The CPU 30 reads out the data items recorded in the RAM card 73 in relation to the positions of the sensing units 620*a* corresponding to essential places such as the safe holes 14*a* and the out hole 15, and it follows up the motions of the metal bodies on the panel of the game machine, such as the situation of hits, in the form of changes in coordinate values, thereby monitoring the progress of a game. Herein, depending upon circumstances, it is possible to manage the end of the game or check any abnormality ascribable to unfair practice, or to utilize the recorded data for pin adjustments, etc.

In a case where the situation in which the metal bodies enter the safe holes is to be monitored in the game machine 10 of new type, the RAM card 73 may be exchanged in conformity with the type. As long as the game machines 10 of the same type are concerned, the RAM cards 73 can be fabricated by copying a single card.

Incidentally, since the signal sending terminals 623 and signal receiving terminals 627 are located on the lower side of the game machine and are respectively connected with the signal sending connector 67*a* and signal receiving connector 67*b* at the inner lower part of the mounting frame, the connections can be reliably effected by utilizing the weight of the inner glass element (front glass) 617. Moreover, in attaching the inner glass element 617 to the mounting frame, the connections can be simultaneously done.

Regarding the exchange and mounting of the inner glass element 617 provided with the sensing matrix 620, the signal sending connector 67*a* and signal receiving connector 67*b* are detachable, and the inner glass element 617 is readily detached from the signal sending circuit 640 and signal receiving circuit 650 of the mounting frame, so that the sensing matrix 620 having become out of order can be easily exchanged. Also, the sensing matrix 620 can be easily installed on a game machine of the type in which this sensing matrix 620 is not packaged.

It is also allowed to locate the signal sending connector 67*a* and signal receiving connector 67*b* at the inner upper part of the mounting frame, and to dispose the signal sending terminals 23 and signal receiving terminals 27 on the upper side of the game machine. In this case, it is possible to render the signal sending circuit board 766*a*, signal receiving circuit board 766*b*, signal sending connector 67*a* and signal receiving connector 67*b* inoffensive to the eye.

In addition, the signal sending lines 622 and signal receiving lines 626 are made of the wire pieces 62, and the turning portions 61 and circumventive portions 64 thereof are formed of the conductor patterns. Therefore, when the wire 62 for detecting the "pachinko" ball is finely formed, the detection portion for the "pachinko" ball does not impede the view of the panel 11 of the "pachinko" game machine 10 and does not offend the game player's eye.

Now, the twelfth embodiment of the present invention will be described.

Figure 31:
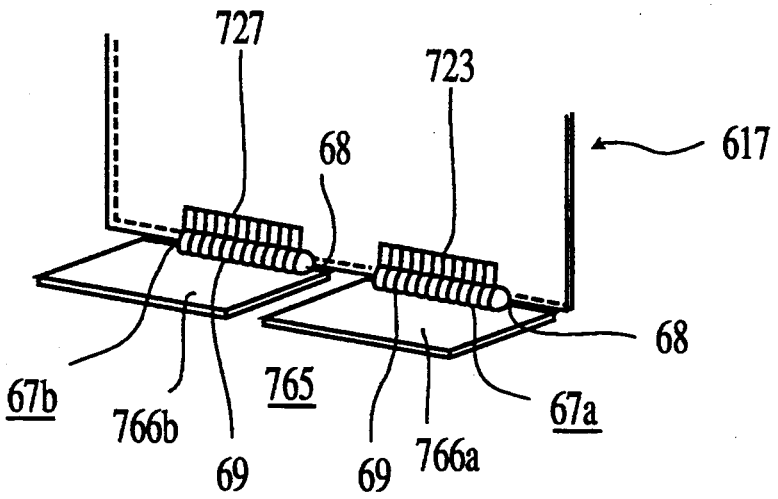
FIG. 31 is a perspective view showing the state in which an inner glass element in the twelfth embodiment of the present invention is connected to a signal sending connector and a signal receiving connector.
Figure 32:
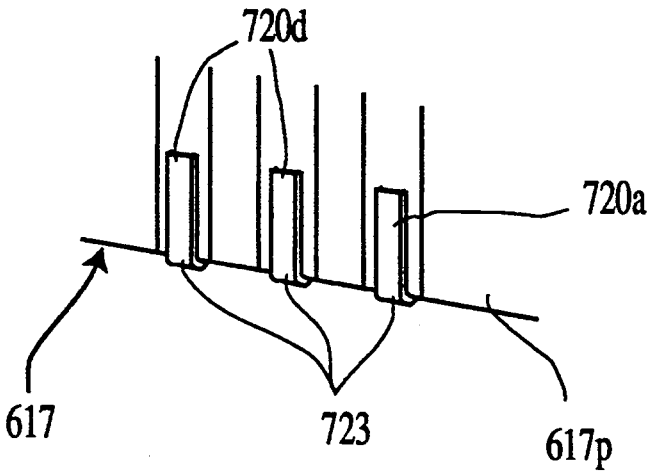
FIG. 32 is a partial enlarged perspective view of signal sending terminals or signal receiving terminals.
Figure 33:
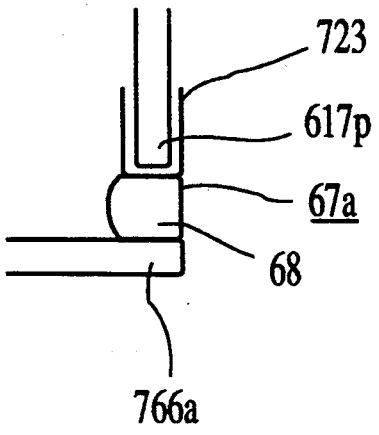
FIG. 33 is a side view showing the state in which the inner glass element is connected to the signal sending connector and the signal receiving connector. ]

FIGS. 31~33 illustrate the twelfth embodiment of the present invention. This embodiment is the same as the eleventh embodiment except for the connections of signal sending terminals with a signal sending circuit and signal receiving terminals with a signal receiving circuit. The same constituents as those of the eleventh embodiment have the same symbols assigned thereto, and shall not be repeatedly explained.

As shown in FIG. 31, a signal sending circuit board 766*a* and a signal receiving circuit board 766*b* are disposed at the inner lower part 765 of a mounting frame, and a signal sending connector 67*a* and a signal receiving connector 67*b* are respectively provided thereon at positions corresponding to the signal sending terminals 723 and the signal receiving terminals 727.

The signal sending connector 67*a* is a rubber connector for detachably connecting the signal sending terminals 723 to the signal sending circuit, while the signal receiving connector 67*b* is a rubber connector for detachably connecting the signal receiving terminals 727 to the signal receiving circuit. More specifically, the signal sending connector 67*a* or signal receiving connector 67*b* is so constructed that a large number of connection leads 69 are wound round an elongate insulator member 68 extending along the signal sending circuit board 766*a* or signal receiving circuit board 766*b*. The connection leads 69 are connected to the signal sending terminals 723 and the corresponding terminals of the signal sending circuit or the signal receiving terminals 727 and the corresponding terminals of the signal receiving circuit in one-to-one or more-to-one correspondence, preferably in five or so-to-one correspondence.

The signal sending terminals 723 and the signal receiving terminals 727 are arranged on the edge of the lower end 617*p* of the inner glass element 617. As shown in FIGS. 32 and 33, the terminals are further overlaid with terminal fixtures 720*a* each of which holds the edge of the lower end 617*p* of the inner glass element 617 between both the inner surfaces thereof.

The signal sending terminals 723 and signal receiving terminals 727 are respectively connected with the signal sending circuit and signal receiving circuit as follows: As shown in FIG. 33, the signal sending terminals 723 and signal receiving terminals 727 are positioned under the inner glass element 617 so as to be connectible with the signal sending connector 67*a* and signal receiving connector 67*b*, and the resulting inner glass element 617 is fitted in the mounting frame so that the signal sending terminals 723 and signal receiving terminals 727 lying on the edge of the inner glass element 617 may be touched and connected with the upper parts of the signal sending connector 67*a* and signal receiving connector 67*b* by the weight of the element 617 which is about 1.2 kg.

Now, the thirteenth embodiment of the present invention will be described.

This embodiment is the same as the eleventh embodiment except that an inner glass element is constructed by stacking the three layers of an inner protective glass plate, a glass base plate and an outer glass plate. The same constituents as those of the eleventh embodiment have the same symbols assigned thereto, and shall not be repeatedly explained.

Figure 34:
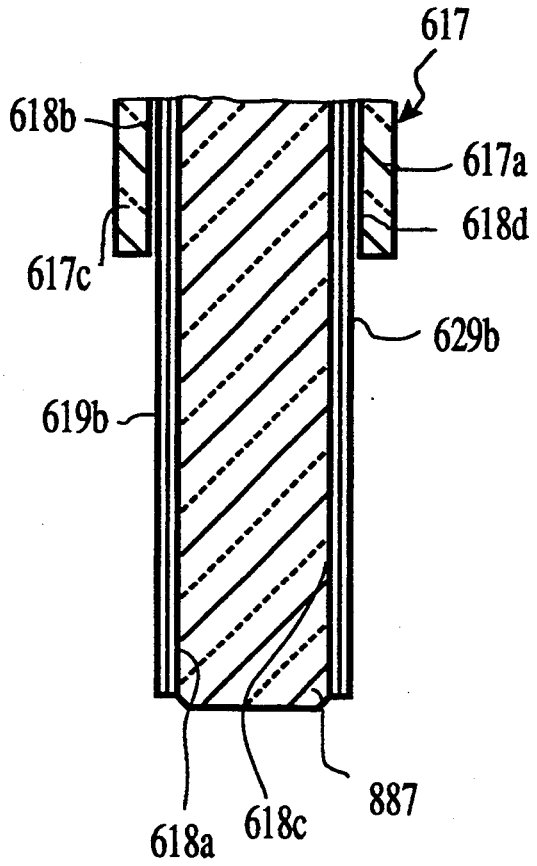
FIG. 34 is an enlarged sectional view of an inner glass element which includes a sensing matrix in the thirteenth embodiment.

FIG. 34 shows the structure of the inner glass element which bears a sensing matrix in the thirteenth embodiment. More specifically, the inner glass element 617 is constructed of the three stacked layers of the inner protective glass plate 617*a*, glass base plate 887 and outer glass plate 617*c*. A plurality of signal receiving lines 626 of paralleled folded-back shape are formed on one surface of the glass base plate 887 and have the inner protective glass plate 617*a* stuck thereon, while a plurality of signal sending lines 622 of paralleled folded-back shape are formed on the opposite surface of the glass base plate 887 and have the outer protective glass plate 617*c* stuck thereon.

Alternatively, in the pattern processing of the signal sending lines 622 and signal receiving lines 626, these lines may well be respectively formed on the surfaces of the inner protective glass plate 617*a* and outer glass plate 617*c*, not on both the surfaces of the glass base plate 887.

Besides, the glass base plate 887 made of glass may well be substituted by a plastic film.

Now, the fourteenth embodiment of the present invention will be described.

This embodiment has the same construction as that of the eleventh embodiment except that each circumventing circuit board is formed with circumventive portions on both the surfaces thereof. The same constituents as those of the eleventh embodiment have the same symbols assigned thereto, and shall not be repeatedly explained.

Figure 35:
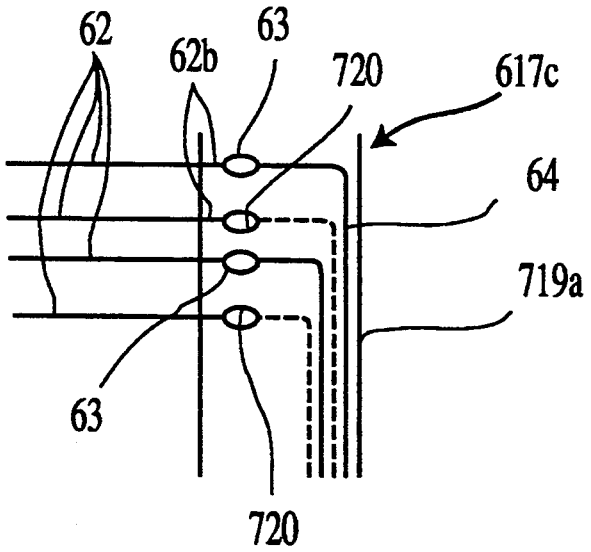
FIG. 35 is a schematic front view of a circumventing circuit board in the fourteenth embodiment.

As shown in FIG. 35, a signal-sending-side glass base plate 617*c* in a square shape is such that a signal-sending-side turning circuit board 719*a* made of an elongate flexible printed-wiring circuit board (FPC) is bonded so as to extend along one vertical latus of this base plate 617*c*, and that the signal-sending-side circumventing circuit board 719 in a letter-L shape is bonded so as to extend along the opposite vertical latus of this base plate 617*c* and part of the bottom latus thereof. As depicted in FIG. 22, a plurality of signal sending terminals 623, specially 64 of them, which are similarly made using a flexible printed-wiring circuit board and which extend vertically for external connections are formed at the lower end of the signal-sending-side circumventing circuit board 719 and along part of the lower-end latus thereof.

The circumventive portions 64 leading to the corresponding signal sending terminals 623 are extended to these signal sending terminals 623 while lying on both the surfaces of the signal-sending-side circumventing circuit board 719 alternately. Among such circumventive portions 64, those which lie on the rear side of the signal-sending-side circumventing circuit board 719, that is, on the side thereof confronting the signal-sending-side glass base plate 617*c* have their start points 64*a* connected to the front side of the signal-sending-side circumventing circuit board 719 by through holes 720 which are formed in the corresponding positions of the circuit board 719. While being tensed, each wire piece 62 extending from the end 61*a* of a corresponding turning portion has its other end 62*b* connected to the start point 64*a* of the circumventive portion 64 on the terminal side by welding or soldering with a solder 63.

In this embodiment, the width of the circumventive portions extending in the vertical direction of the glass base plate can be easily set as small as, for example, about 10 mm or less.

Incidentally, similarly to the signal-sending-side circumventing circuit board 719, the signal-receiving-side circumventing circuit board of a signal-receiving-side glass base plate can be formed with the alternate circumventive portions on both its surfaces by providing through holes therein.

In order to make the width of the circumventive portions small, a structure in which a plurality of circumventing circuit boards are stacked may well be adopted instead of the above structure in which the circumventive portions are disposed on both the surfaces of the circumventing circuit board.

Now, the fifteenth embodiment of the present invention will be described. This embodiment is an example of a metal detection apparatus which has a 1measure against noise. The noise reduction measure adopted in this embodiment can be applied to various aspects in the present invention, for example, the foregoing embodiments.

Figure 36:
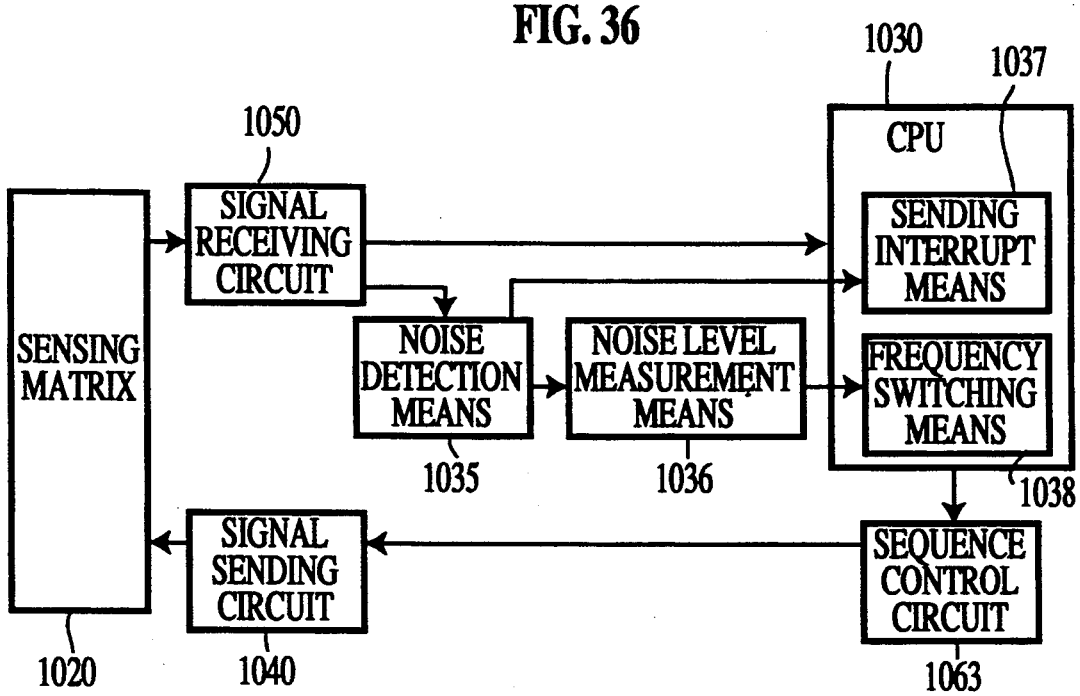
FIG. 36 is a block diagram showing the construction of noise reduction means.

As shown in FIG. 36, the metal detection apparatus in this embodiment includes noise detection means 1035 and noise level measurement means 1036, and signal sending interrupt means 1037 and frequency switching means 1038 which are included in a CPU 1030.

The noise detection means 1035 is means for accepting a signal received by a signal receiving circuit 1050, and for delivering a noise signal when the noise of the accepted signal has been detected. The noise level measurement means 1036 is means connected to the noise detection means 1035, for measuring the levels of the detected noise of the noise detection means 1035 at respective frequencies. Herein, by way of example, the levels may be measured for specified frequency components set in advance or may well be measured for the respective frequencies obtained by the frequency analysis of the noise.

The signal sending interrupt means 1037 and the frequency switching means 1038 are respectively formed by running specified programs in the CPU 1030. The signal sending interrupt means 1037 is means for stopping the delivery of a signal sending clock from a sequence control circuit 47 in accordance with the noise signal from the noise detection means 1035, thereby interrupting the signal sending operation of a signal sending circuit 1040. The frequency switching means 1038 is means for changing-over the frequency of the sending signal of the signal sending circuit 1040 to a frequency which is not susceptible to the detected noise, on the basis of the measured result of the noise level measurement means 1036. The change-over to the frequency which is not susceptible to the noise is effected between, for example, the two preset frequencies of 1 MHz and 1.3 MHz. Incidentally, the frequencies can be changed-over, not only by the program, but also by hardware.

Next, the operation of eliminating the influence of the noise will be described.

When the noise is contained in the received signal of the signal receiving circuit 1050, the noise detection means 1035 detects this noise. The signal sending interrupt means 1037 interrupts the signal sending operation of the signal sending circuit 1040 in accordance with the noise signal from the noise detection means 1035. The noise level measurement means 1036 measures the levels of the respective frequencies of the noise detected by the noise detection means 1035. On the basis of the measured result, the frequency switching means 1038 changes-over the frequency of the sending signal of the signal sending circuit 1040 to the frequency which is not susceptible to the detected noise, between the two preset frequencies of 1 MHz and 1.3 MHz. In this way, a favorable accuracy of detection for the "pachinko" ball can be attained without being influenced by the noise.

According to such a construction, various types of machines which develop noise of different frequencies can be coped with by the single sort of metal detection apparatus.

In this embodiment, the frequency switching means 1038 may well utilize a system in which the sending signal frequency is changed-over to any desired frequency by the use of a PLL (phase-locked loop), instead of the system in which either of the two frequencies is selected.

Now, the sixteenth embodiment of the present invention will be described. This embodiment consists in comprising a signal receiving circuit in which means for detecting a current induced in each signal receiving line is altered.

This embodiment is the same as the embodiment shown in FIG. 27, except that the CT sensors are replaced with amplifiers.

Figure 37:
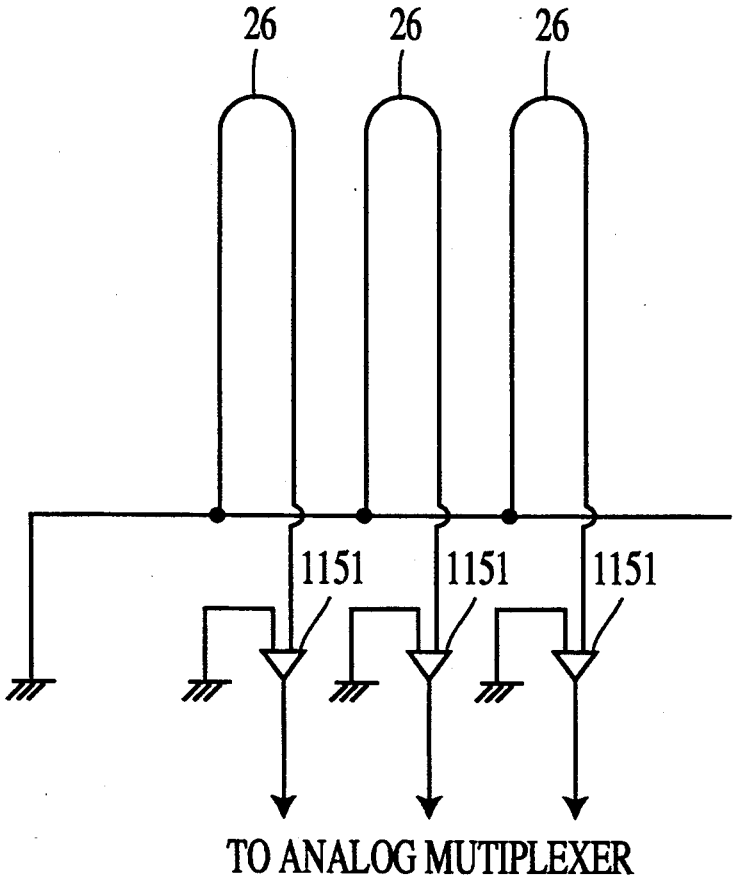
FIG. 37 is a circuit diagram showing another example of the amplification means of a signal receiving circuit.

As shown in FIG. 37, in the signal receiving circuit, the amplifiers of 32 circuit channels 1151 are respectively connected on the sides of the signal receiving lines of 32 circuit channels 26. The amplifiers 1151 amplify signals from the signal receiving lines 26, and deliver the amplified signals to an analog multiplexer. In this manner, the signal receiving circuit can be configured by substituting the amplifiers 1151 for the CT sensors.

Incidentally, in each of the embodiments, the turning circuit boards or/and the circumventing circuit boards may well be made of thin, glass epoxy circuit boards in lieu of the flexible printed-wiring circuit boards (FPC). Since the glass epoxy circuit board is opal in color, it is inoffensive to the eye when in use. Besides, since it is immune to heat, it is prevented from being thermally broken down when the wire pieces of the signal sending lines and signal receiving lines are soldered.

The signal sending terminals and the signal receiving terminals can be brought into the structure in which they are concentratedly arranged on the lower end side in relation to the inner glass element (front glass) as mounted on the game machine. Of course, this structure is not restrictive, but the terminals may well be concentratedly arranged on the upper end side of the inner glass element. Thus, it is possible to render the signal sending connector, signal receiving connector, signal sending circuit board and signal receiving circuit board inoffensive to the eye. Besides, in the case where the end parts of the signal sending lines and those of the signal receiving lines are respectively located at one end of the base plate as the signal sending terminals and the signal receiving terminals, the lines can be respectively connected reliably with the signal sending connector and the signal receiving connector by utilizing the weight of the base plate.

Besides, in each of the embodiments, the turning portions formed of the conductor patterns may well be replaced with ones in which the wire pieces of the signal sending lines and signal receiving lines are directly turned back and in which the turned-back parts are fixed with a binder.

As described above, according to the embodiments of the present invention, any position of existence of a metal body within a specified space can be detected without actual contact with the metal body and without employing contacts which require a physical contact with the metal object. Thus, according to the present invention, various problems attendant upon the provision of the contacts or the likes can be solved, and the durability and the reliability can be enhanced in the detection of the metal body.

Especially, the present invention is well suited to the detection of the position of existence of the metal body which is moving or remains stationary within the specified space, particularly a space held between parallel planes. In, for example, a game machine, it is permitted to easily and quickly obtain data items on the trajectories of the metal bodies on a panel, the number of the metal bodies struck by a game player, the rate of the metal balls entering safe holes, etc., and the details of a game can be known in a remote place. Therefore, the level of the attribute management of the game machine can be enhanced, and anybody can adjust the pins of the game machine with ease. Also, the distribution of the metal bodies on the plane can be detected with ease.

INDUSTRIAL APPLICABILITY

The present invention is applicable to any of various equipments for detecting the position of a metal body existent in a specified space. By way of example, it is applicable to the detection of the trace of the metal body in a game machine in which this metal body is moved along a panel. Besides, the distribution of the positions of existence of the metal body can be detected by placing the metal body on a sensing matrix which constitutes the present invention. An apparatus for recognizing the shape of the metal body itself can be constructed by utilizing the above distribution of existence of the metal body. In addition, a system for managing goods can be built by utilizing information on the distribution of existence of the metal bodies. Further, it is possible to construct a sensor for inputting instructions etc. in such a way that the metal body is brought near to the desired positions of the sensing matrix constituting the present invention.

We claim:

1. An apparatus for detecting a metal body, movable in a gaming machine, comprising:

a panel along which the metal body moves;

a plurality of signal sending lines having a first predetermined layout shape and generating a magnetic field in response to a current; and a plurality of signal receiving lines having a second predetermined layout shape and electromagnetically coupled to said plurality of signal sending lines to detect a magnetic flux change in said plurality of signal sending lines caused by the metal body to determine the location of the metal body in the gaming machine, wherein a plane of said plurality of signal sending lines and a plane of receiving lines are parallel to each other, wherein the plurality of signal sending lines are coplanar, and the plurality of signal receiving lines are coplanar, said plurality of signal sending and receiving lines are arranged to intersect each other and form a sensing matrix which is arranged in opposition to said panel while holding therebetween a space which is, at least, large enough to pass the metal body, thereby detecting a position of the metal body.

2. An apparatus for detecting a metal body of claim 1, wherein said sending matrix is constructed by arranging said plurality of signal sending lines and said plurality of signal receiving lines intersect orthogonally to form said sensing matrix.

3. An apparatus for detecting a metal body of claim 1, wherein said sensing matrix includes a base plate having a first plane and a second plane which is parallel to the first plane, said plurality of signal sending lines being formed on a surface of said base plate and said plurality of signal receiving lines being formed on the other surface of said base plate and intersecting said plurality signal sending lines.

4. An apparatus for detecting a metal body of claim 3, wherein end parts of said plurality of signal sending lines and those of said plurality of signal receiving lines are located at one end of said base plate to form respectively, signal sending terminals and signal receiving terminals of said sensing matrix.

5. An apparatus for detecting a metal body of claim 3 wherein said base plate is a glass plate.

6. An apparatus for detecting a metal body of claim 1, wherein said plurality of signal sending lines and said plurality of signal receiving lines are formed on both surfaces of a base plate, the base plate having protective sheets on both surfaces.

7. An apparatus for detecting a metal body of claim 1, wherein said sensing matrix includes a base plate, said plurality of signal sending lines being arranged on a surface of said base plate and said plurality of signal receiving lines being arranged on the other surface of said base plate to intersect said signal sending lines, and protective sheets covering both said plurality of signal sending and receiving lines.

8. An apparatus for detecting a metal body of claim 1, wherein said sensing matrix includes first and second base plates, said plurality of signal sending lines being arranged on a surface of said first base plate and said plurality of signal receiving lines being arranged on a surface of said second base plate, and both said base plates being placed together at their respective surfaces which are not provided with said plurality of signal sending and receiving lines.

9. An apparatus for detecting a metal body of claim 1, wherein said sensing matrix includes first and second base plates, said plurality of signal sending lines being arranged on a surface of said first base plate and said plurality of signal receiving lines being arranged on a surface of said second base plate, both said base plates are placed together at their respective surfaces which are not provided with said plurality of signal sending and receiving lines, and protective sheets covering said plurality of signal sending and receiving lines and both of the base plates.

10. An apparatus for detecting a metal body of claim 9, wherein aid plurality of signal sending lines includes signal sending terminals at their end parts, and said plurality of signal receiving lines includes signal receiving terminals at their end parts.

11. An apparatus for detecting a metal body of claim 10, wherein said protective sheets are respectively arranged so as to cover said base plates except parts of said signals sending terminals and said signal receiving terminals.

12. An apparatus for detecting a metal body of claim 9, wherein said base plates and said protective sheets are glass base plates, and said protective sheets are stuck on said plurality of signal sending and receiving lines and on said base plates with a transparent adhesive.

13. An apparatus for detecting a metal body of claim 12, wherein said plurality of signal sending and receiving lines are constructed by forming patterns of electric conductor on said base plates.

14. An apparatus for detecting a metal body of claim 12, wherein a transparent conductor film is provided on an upper surface of said protective sheet overlying said plurality of signal sending lines.

15. An apparatus for detecting a metal body of claim 1, wherein each line of said plurality of signal sending and receiving lines includes a paralleled portion having an outward path and a return path, and a turning portion, which turns each line from said outward path back to said return path.

16. An apparatus for detecting a metal body of claim 15, wherein said plurality of signal sending and said signal receiving lines have their paralleled portions made from pieces of wire.

17. An apparatus for detecting a metal body of claim 16, wherein said turning portions of said plurality of signal sending lines are formed of electric conductor patterns on a signal sending side turning circuit board, said turning portions of said plurality of signal receiving lines are formed of electric conductor patterns on a signal receiving side turning circuit board, and one end of each piece of wire is connected to said conductor patterns of a corresponding one of said signal sending side turning circuit board and said signal receiving side turning circuit board.

18. An apparatus for detecting a metal body of claim 17, wherein:

said plurality of signal sending lines include signal sending terminals and circumventive portions leading to said signal sending terminals at its end side, while said plurality of signal receiving lines include signal receiving terminals and circumventive portions leading to said signal receiving terminals at its end side; and a signal sending side circumventing circuit board on which said circumventive portions of said plurality of signal sending lines are formed of an electric conductor pattern, and a signal receiving side circumventing circuit board on which said circumventive portions of said plurality of signal receiving line are formed of an electric conductor pattern are bonded to said base plate, with the other end of each piece of wires connected to an initial point of a corresponding one of said circumventive portions of said plurality of signal sending and receiving lines.

19. An apparatus for detecting a metal body of claim 17, wherein each of said signal sending side turning circuit board and said signal receiving side turning circuit board is made of a flexible printed circuit board.

20. An apparatus for detecting a metal body of claim 1, wherein said panel comprises:

a plurality of safe holes, each of which serves to make a hit when the metal body has entered said hole to be driven out of said panel, and a single out hole into which metal bodies having failed to enter said safe holes are finally gathered to be driven out of said panel;

a plurality of pins being planted on said panel substantially perpendicularly thereto in a state in which they protrude from said panel to the amount of a length corresponding to a diameter of the metal body, such that the metal body falling along said panel may frequently collide against said pins to have its direction of movement altered; and a projectile mechanism for projecting the metal body to an upper part of said panel.

21. An apparatus for detecting a metal body of claim 20, wherein said pins have their distribution predetermined and are arranged on said panel so that, while altering the direction of movement of the metal body, said pins also lead the metal body to proceed toward said safe hole in some cases and to miss said safe hole in the other cases, whereby said apparatus is used as a game machine and detects a metal ball employed as the metal body.

22. An apparatus for detecting a metal body of claim 1, wherein said sensing matrix further comprises a base plate having on one side terminals of said plurality of signal sending lines and terminals of said plurality of signal receiving lines arranged in rows, and said plurality of signal sending and receiving lines intersecting each other on said base plate.

23. A game machine comprising:

a) a metal body movable in the gaming machine;

b) a panel along which said metal body moves;

c) a projectile mechanism for projecting the metal body to an upper part of said panel; and d) a sensing matrix for detecting a position of the metal body, said sensing matrix having i) a plurality of signal sending lines having a first predetermined layout shape and generating a magnetic field in response to a current, and ii) a plurality of signal receiving lines having a second predetermined layout shape and electromagnetically coupled to said plurality of signal sending lines to detect a magnetic flux change in said plurality of signal sending lines caused by the metal body to determine the position of the metal body in the gaming machine, wherein a plane of said plurality of signal sending lines and a plane of said plurality of receiving lines are parallel to each other.

24. The gaming machine of claim 23, wherein said panel comprises:

a plurality of safe holes, each of which serves to make a hit when the metal body has entered any of said safe holes to be driven out of said panel, and a single out hole into which metal bodies having failed to enter said safe holes are finally gathered to be driven out of said panel; and a plurality of pins planted on said panel substantially perpendicularly thereto in a state in which they protrude from said panel to the amount of a length corresponding to a diameter of the metal body, such that the metal body moving along said panel may frequently collide against said pins to have its direction of movement altered.

25. The gaming machine of claim 23, wherein said pins have their distribution predetermined and are arranged on said panel so that, while altering the direction of movement of the metal body, said pins also lead the metal body to proceed toward said safe hole in some cases and to miss said safe hole in the other cases.

* * * * *